US011786876B2

(12) United States Patent
Ronning

(10) Patent No.: US 11,786,876 B2
(45) **Date of Patent: *Oct. 17, 2023**

(54) STATIC MIXER

(71) Applicant: RE MIXERS, INC., Madison, WI (US)

(72) Inventor: Eric Adam Ronning, Madison, WI (US)

(73) Assignee: RE MIXERS, INC., Madison, WI (US)

( * ) Notice: Subject to any disclaimer, the term of this patent is extended or adjusted under 35 U.S.C. 154(b) by 316 days.

This patent is subject to a terminal disclaimer.

(21) Appl. No.: 17/076,650

(22) Filed: Oct. 21, 2020

(65) Prior Publication Data

US 2021/0031158 A1 Feb. 4, 2021

Related U.S. Application Data

(63) Continuation of application No. 15/526,556, filed as application No. PCT/US2016/061652 on Nov. 11, 2016, now Pat. No. 10,898,872.

(60) Provisional application No. 62/254,954, filed on Nov. 13, 2015.

(51) Int. Cl.

| | |
|---|---|
| ***B01F 25/432*** | (2022.01) |
| ***B01F 35/52*** | (2022.01) |
| ***B05C 17/005*** | (2006.01) |

(52) U.S. Cl.

CPC ..... *B01F 35/522* (2022.01); *B01F 25/4321* (2022.01); *B05C 17/00553* (2013.01)

(58) Field of Classification Search

CPC ..... B01F 25/4321
USPC ..... 366/336–340
See application file for complete search history.

(56) References Cited

U.S. PATENT DOCUMENTS

| | | | | |
|---|---|---|---|---|
| 1,496,896 A | | 6/1924 | Laffoon | |
| 2,085,132 A | | 6/1937 | Underwood | |
| 3,195,865 A | | 7/1965 | Harder | |
| 3,404,869 A | | 10/1968 | Harder | |
| 3,406,947 A | | 10/1968 | Harder | |
| 3,625,258 A | * | 12/1971 | Phelps | F16L 9/18 D6/709 |

(Continued)

FOREIGN PATENT DOCUMENTS

| | | |
|---|---|---|
| CN | 1720094 A | 1/2006 |
| EP | 1153651 B1 | 10/2005 |

(Continued)

OTHER PUBLICATIONS

Ronning, "140501 ME351 Presentation Packet 1," May 8, 2014, (7 pages).

(Continued)

*Primary Examiner* — David L Sorkin
(74) *Attorney, Agent, or Firm* — CASIMIR JONES, SC; Brian F. Bradley

(57) ABSTRACT

A mixer including a first inlet channel, a second inlet channel, a third inlet channel, and a first dividing wall between the first inlet channel and the second inlet channel. A first opening and a second opening are formed in the first dividing wall. The mixer further includes a second dividing wall between the second inlet channel and the third inlet channel with a third opening and a fourth opening formed in the second dividing wall. The first opening is aligned with the third opening along a first axis and the second opening is aligned with the fourth opening along a second axis.

19 Claims, 32 Drawing Sheets

(56) References Cited

U.S. PATENT DOCUMENTS

| | | | |
|---|---|---|---|
| 3,643,927 | A | 2/1972 | Crouch |
| 3,647,187 | A | 3/1972 | Dannewitz et al. |
| 3,860,217 | A | 1/1975 | Grout |
| 3,893,654 | A | 7/1975 | Miura et al. |
| 4,032,114 | A | 6/1977 | Kolm |
| 4,053,141 | A | 10/1977 | Gussefeld |
| 4,072,296 | A | 2/1978 | Doom |
| 4,093,188 | A | 6/1978 | Horner |
| 4,112,520 | A | 9/1978 | Gilmore |
| 4,145,520 | A | 3/1979 | Feltgen et al. |
| 4,363,552 | A | 12/1982 | Considine |
| 4,801,008 | A | 1/1989 | Rich |
| 4,848,920 | A | 7/1989 | Heathe et al. |
| 5,425,581 | A | 6/1995 | Palm |
| 5,489,153 | A | 2/1996 | Berner et al. |
| 5,620,252 | A | 4/1997 | Maurer |
| 5,688,047 | A | 11/1997 | Signer |
| 5,851,067 | A | 12/1998 | Fleischli et al. |
| 5,971,603 | A | 10/1999 | Davis et al. |
| RE36,969 | E | 11/2000 | Streiff et al. |
| 6,412,975 | B1 | 7/2002 | Schuchardt et al. |
| 6,431,528 | B1 | 8/2002 | Kojima |
| 6,467,949 | B1 | 10/2002 | Reeder et al. |
| 6,550,960 | B2 | 4/2003 | Catalfamo et al. |
| 6,553,755 | B2 | 4/2003 | Hofmann et al. |
| 6,575,617 | B2 | 6/2003 | Fleischli et al. |
| 6,595,679 | B2 | 7/2003 | Schuchardt |
| 6,599,008 | B2 | 7/2003 | Heusser et al. |
| 6,623,155 | B1 | 9/2003 | Baron |
| 6,637,928 | B2 | 10/2003 | Schuchardt |
| 6,676,286 | B2 | 1/2004 | Grütter et al. |
| 6,701,963 | B1 * | 3/2004 | Hill ..... F15D 1/04 138/116 |
| 6,769,801 | B1 | 8/2004 | Maurer et al. |
| 6,773,156 | B2 | 8/2004 | Henning |
| 6,830,370 | B1 * | 12/2004 | Uematsu ..... B01F 25/4316 366/337 |
| 6,899,453 | B2 | 5/2005 | Koch et al. |
| 7,198,400 | B2 | 4/2007 | Unterlander et al. |
| 7,316,503 | B2 | 1/2008 | Mathys et al. |
| 7,322,740 | B2 | 1/2008 | Heusser et al. |
| 7,390,121 | B2 | 6/2008 | Jähn et al. |
| 7,438,464 | B2 | 10/2008 | Moser et al. |
| 7,510,172 | B2 * | 3/2009 | Kojima ..... B01F 25/43141 96/326 |
| 7,793,494 | B2 | 9/2010 | Wirth et al. |
| D625,771 | S | 10/2010 | Kojima |
| 7,841,765 | B2 | 11/2010 | Keller |
| 7,985,020 | B2 | 7/2011 | Pappalardo |
| 8,061,890 | B2 | 11/2011 | Suhner |
| 8,083,397 | B2 | 12/2011 | Pappalardo |
| 8,684,593 | B2 | 4/2014 | Moser et al. |
| 8,696,193 | B2 | 4/2014 | Herbstritt |
| 8,753,006 | B2 | 6/2014 | Habibi-Naimi |
| 8,936,391 | B2 | 1/2015 | Stoeckli et al. |
| 9,003,771 | B2 | 4/2015 | Peters et al. |
| 9,452,371 | B2 | 9/2016 | Gäbler et al. |
| 10,898,872 | B2 * | 1/2021 | Ronning ..... B05C 17/00553 |
| 2002/0117224 | A1 * | 8/2002 | Vakili ..... G01M 9/04 138/116 |
| 2008/0038425 | A1 | 2/2008 | Wilken |
| 2008/0232191 | A1 | 9/2008 | Keller |
| 2009/0122638 | A1 | 5/2009 | Sato et al. |
| 2010/0260009 | A1 | 10/2010 | Kingsford |
| 2016/0236161 | A1 | 8/2016 | Pappalardo |

FOREIGN PATENT DOCUMENTS

| | | | |
|---|---|---|---|
| EP | 1125626 | B1 | 11/2005 |
| EP | 1437173 | B1 | 1/2006 |
| EP | 2058048 | A1 | 5/2009 |
| EP | 1712751 | B1 | 7/2012 |
| JP | 53-139672 | U | 4/1952 |
| JP | 62-269733 | A | 11/1967 |
| JP | 2000-354749 | A | 12/2000 |
| JP | 2004-188415 | A | 7/2004 |
| JP | 2009-113012 | A | 5/2009 |
| KR | 101379418 | B1 | 3/2014 |
| WO | 8900076 | A1 | 1/1989 |
| WO | 2007110316 | A1 | 10/2007 |
| WO | 2001119820 | A1 | 9/2011 |
| WO | 2012116873 | A1 | 9/2012 |

OTHER PUBLICATIONS

Ronning, "The PEC Mixer, A physical realization of Erwin's Law," Jan. 24, 2013, (28 pages).

Ronning et al., "Erwin Mixer," Oct. 8, 2013, (61 pages).

International Search Report and Written Opinion for Application No. PCT/US2016/061652 dated Mar. 13, 2017 (10 pages).

Extended European Search Report dated Jun. 14, 2019 for corresponding European Application No. 16865144.6 (7 pages).

Japan Office Action dated Sep. 25, 2020 for corresponding Japanese Application No. 2018-544774 (12 pages).

Chinese Office Action dated Sep. 17, 2020 for corresponding Chinese Application No. 201680073041.0 (16 pages).

Indian Office Action dated Nov. 26, 2020 for corresponding Indian Application No. 201817017884 (9 pages).

* cited by examiner

STATIC MIXER

CROSS-REFERENCE TO RELATED APPLICATIONS

This application claims priority as a continuation of co-pending U.S. patent application Ser. No. 15/526,556 filed on May 12, 2017, which is a national phase filing of International Patent Application No. PCT/US2016/061652, filed on Nov. 11, 2016, which claims priority to U.S. Provisional Patent Application No. 62/254,954 filed on Nov. 13, 2015, the entire contents of each of which is hereby incorporated herein by reference.

TECHNICAL FIELD OF INVENTION

The present invention relates to a static mixer.

BACKGROUND OF THE INVENTION

A number of conventional motionless (i.e., static) mixer types exist that implement a similar general principle to mix fluids together. Specifically, fluids are mixed together by dividing and recombining the fluids in an overlapping manner. This action is achieved by forcing the fluid over a series of baffles of alternating geometry. Such division and recombination causes the layers of the fluids being mixed to diffuse past one another, eventually resulting in a generally homogenous mixture of the fluids.

With reference to FIG. 1, a conventional static mixer 10 is illustrated with a series of alternating baffles 14 consisting of right-handed mixing baffles 18 and left-handed mixing baffles 22 located in a housing 26 to perform the continuous division and recombination. Using the static mixer 10 often results in a streaking phenomenon with streaks of fluid forming along the interior surfaces of the mixer housing 26 that pass through the mixer essentially unmixed.

Furthermore, to achieve adequate mixing (i.e., a generally homogenous mixture) additional baffles 18, 22 must be placed in the mixer 10 to thoroughly diffuse the material, thus increasing the mixer's overall length. The conventional mixer 10 of FIG. 1 includes a length 30 that extends from an inlet end 34 to an outlet end 38. Such an increase in mixer length is unacceptable in many motionless mixer applications, such as handheld mixer-dispensers. In addition, longer mixers generally have a higher retained volume and higher amounts of waste material as a result. A large amount of waste material is particularly undesirable when dealing with expensive materials. In other words, the length 30 of the conventional static mixer 10 is large, resulting in a large amount of wasted material that must pass through the static mixer 10 before any output is usable.

SUMMARY OF THE INVENTION

Embodiments described herein disclose, for example, a mixer including a first inlet channel, a second inlet channel, a third inlet channel, and a first dividing wall between the first inlet channel and the second inlet channel. A first opening and a second opening are formed in the first dividing wall. The mixer further includes a second dividing wall between the second inlet channel and the third inlet channel with a third opening and a fourth opening formed in the second dividing wall. The first opening is aligned with the third opening along a first axis and the second opening is aligned with the fourth opening along a second axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 2:
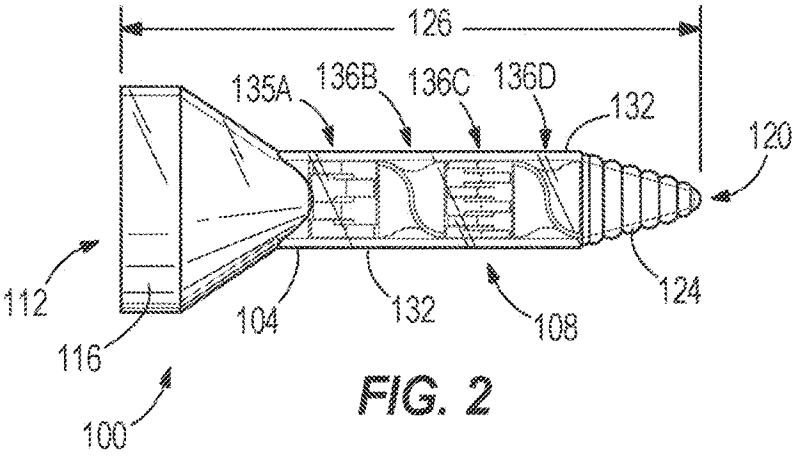
FIG. 2 is a side view of a static mixer according to an aspect of the invention.
Figure 3:
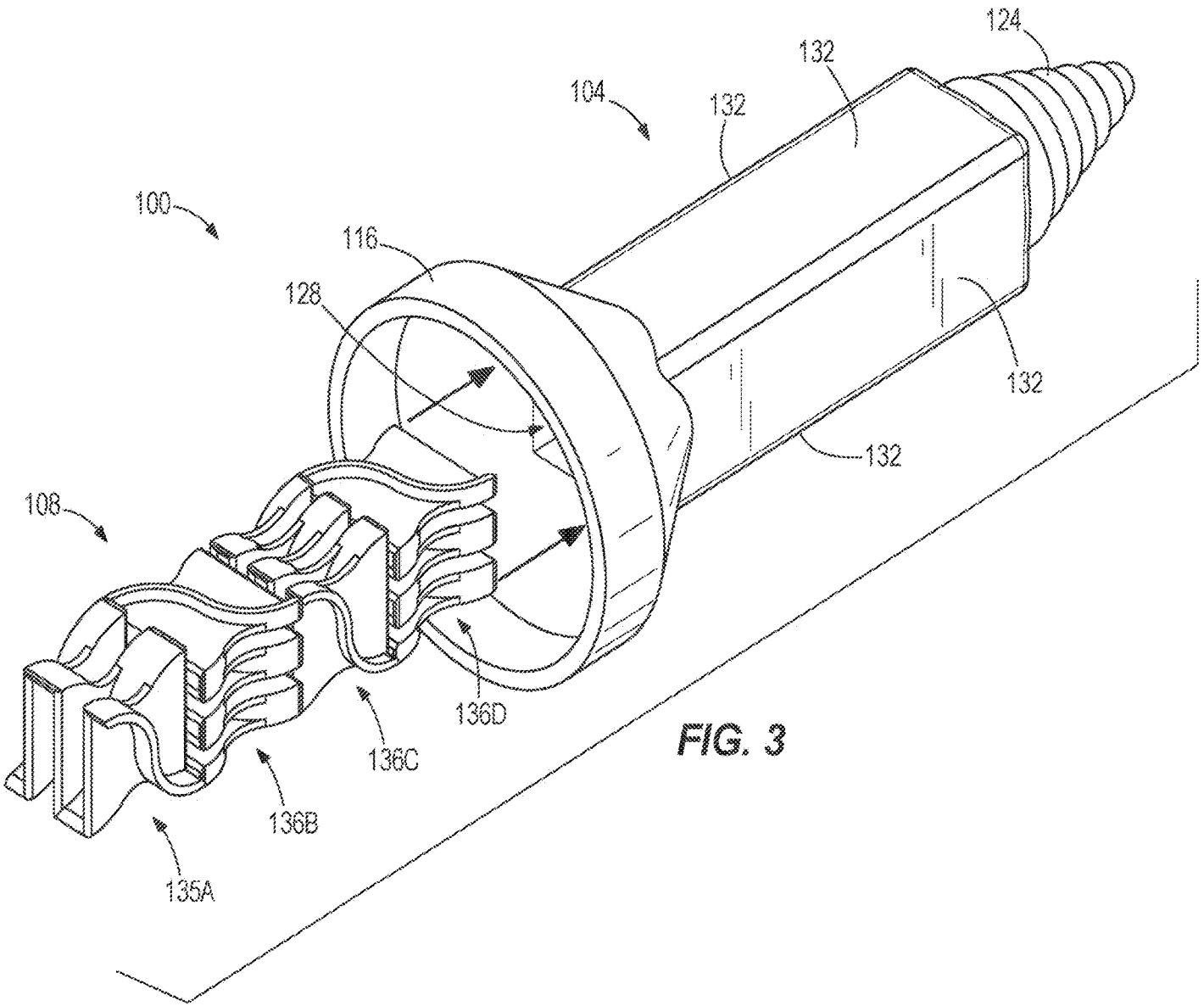
FIG. 3 is an exploded view of the static mixer of FIG. 2 illustrating a mixer assembly.

With reference to FIGS. 2 and 3, a static mixer 100 according to one embodiment of the invention is illustrated. The static mixer 100 includes a housing 104 and a mixer assembly 108 received within the housing 104. Specifically, the housing 104 includes an inlet end 112 formed with an inlet socket 116 and an outlet end 120 formed with a nozzle 124. The inlet end 112 and the outlet end 120 define a material flow path that extends therebetween. In other words, the inlet end 112 is upstream in the material flow path from the outlet end 120. In the illustrated embodiment, the inlet socket 116 is formed as a bell-type inlet, but in alternative embodiments the inlet socket 116 may be formed as a bayonet-type inlet. Other inlet configurations known to those of ordinary skill in the art may also be used.

With continued reference to FIG. 2, the static mixer 100 includes an overall length 126, which is smaller than the overall length 30 of the conventional static mixer 10. As explained in greater detail below, the static mixer 100 is able to create a more homogenous mixture (i.e., improved results) with a shorter overall length (i.e., less wasted material) compared to the conventional mixer 10. With reference to FIG. 3, the mixer assembly 108 is received within a chamber 128 (i.e., channel) defined by the housing 104. In the illustrated embodiment, the chamber 128 is square-shaped with four chamber walls 132. In alternative embodiments, the chamber 128 may be circular-shaped to correspond to a circular-shaped mixer element (see, for example, mixer element 836 shown in FIGS. 19-20). The mixer assembly 108 includes four mixer elements 135A, 136B, 136C, 136D, one of which is illustrated in FIGS. 4-9. As explained in greater detail below, two or more separate fluids (e.g., gasses, liquids, and/or fluidized solids) enter the inlet end 112 of the housing 104, pass through the mixer assembly 108 and exit through the outlet end 120 as a homogenous mixture.

Figure 4:
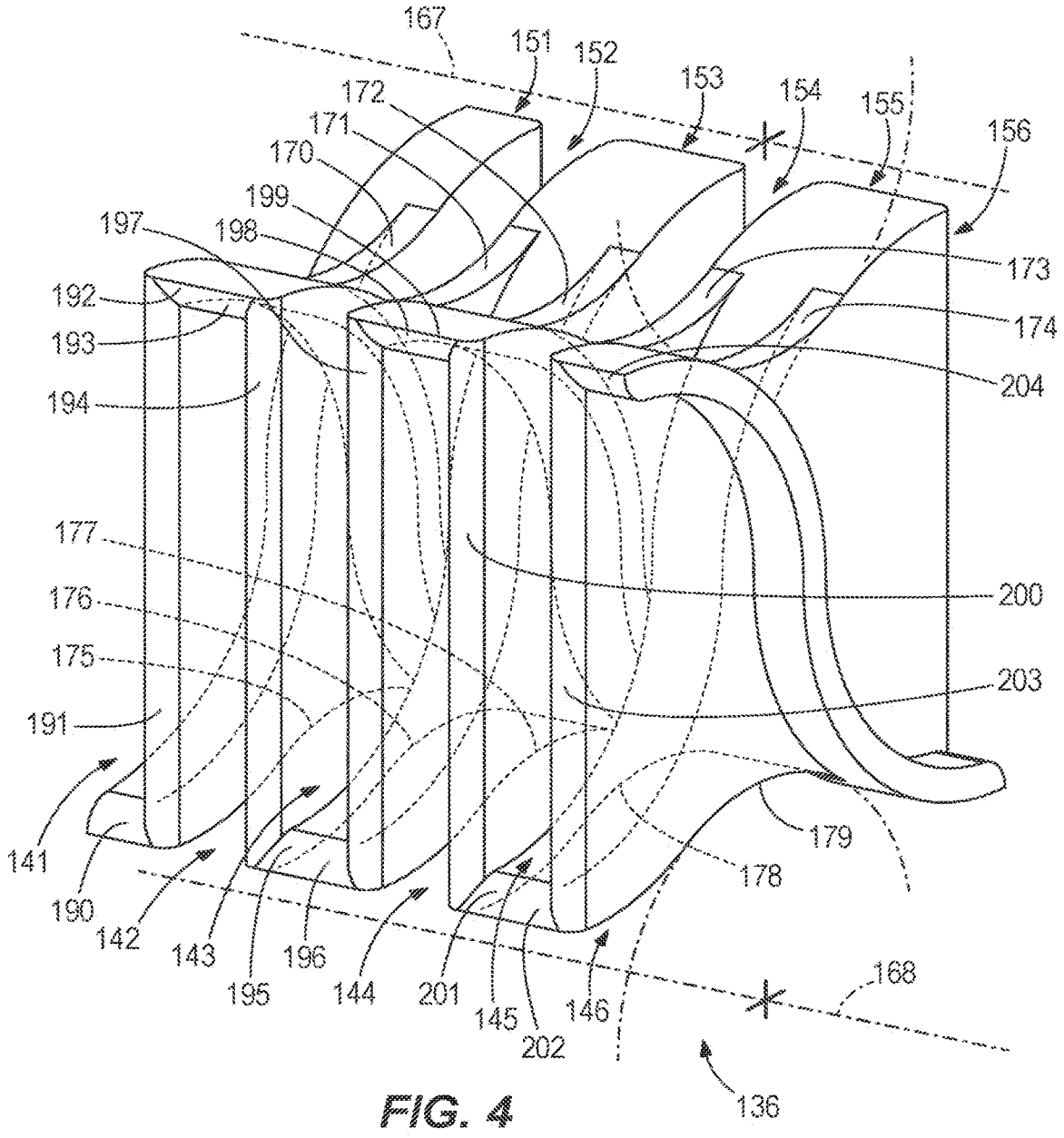
FIG. 4 is a perspective view of a mixer element of the mixer assembly of FIG. 3.
Figure 5:
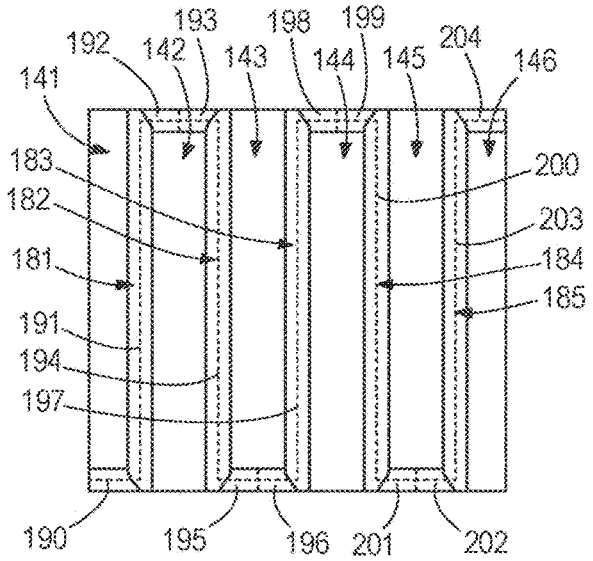
FIG. 5 is a front view of the mixer element of FIG. 4.
Figure 6:
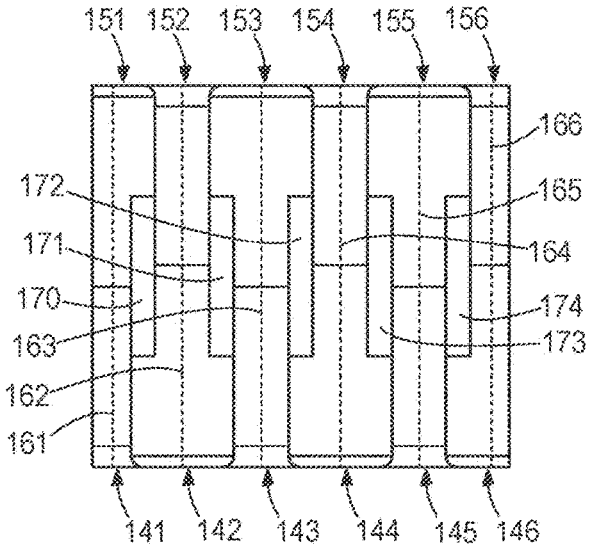
FIG. 6 is a top view of the mixer element of FIG. 4.
Figure 7:
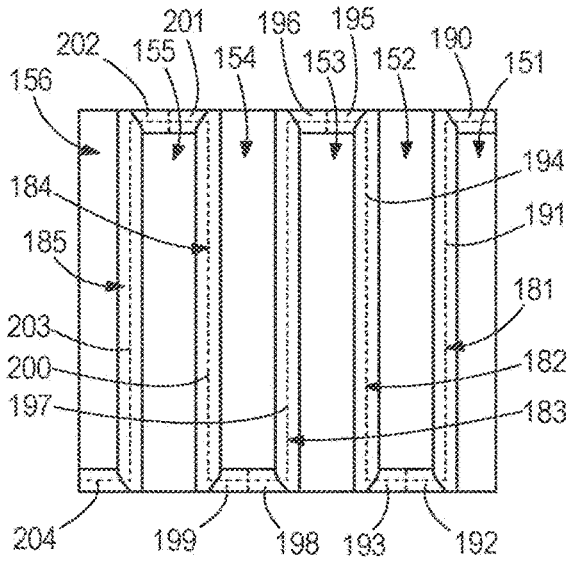
FIG. 7 is a rear view of the mixer element of FIG. 4.
Figure 8:
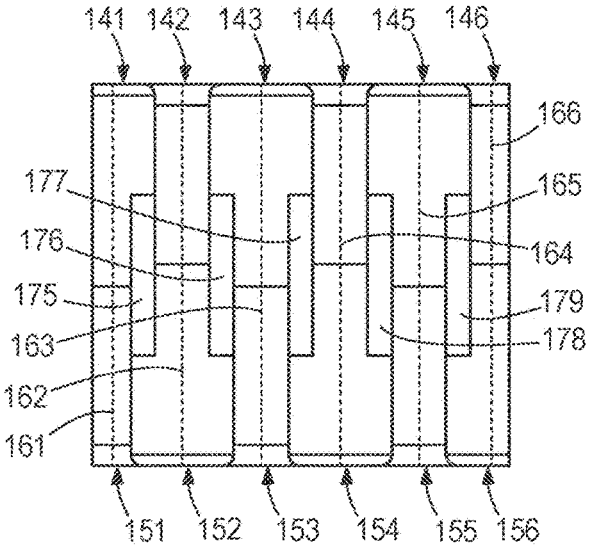
FIG. 8 is a bottom view of the mixer element of FIG. 4.

With reference to FIGS. 4-9, the mixer element 136 includes six inlet channels 141-146 (FIG. 5) and six outlet channels 151-156 (FIG. 7). For the purposes of this description, the inlet channels 141-146 and the outlet channels 151-156 are numbered left to right from one to six, as viewed from FIG. 4. The inlet channels 141-146 are upstream in a material flow path of the outlet channels 151-156. With reference to FIG. 6, each of the outlet channels 151-156 is aligned with a corresponding inlet channel 141-146 along an axis 161-166. For example, the first outlet channel 151 is aligned with the first inlet channel 141 along the first axis 161, and second outlet channel 152 is aligned with the second inlet channel 142 along the second axis 162. In addition, third outlet channel 153 is aligned with the third inlet channel 143 along the third axis 163, and so forth. The first axis 161 is approximately parallel with the second axis 162. In the illustrated embodiment of FIGS. 4-9, all of the axes 161-166 are parallel with each other.

The mixer element 136 further includes a first set of openings 170-174 and a second set of openings 175-179. Specifically, the first set of openings 170-174 includes a first opening 170, a third opening 171, a fifth opening 172, a seventh opening 173, and a ninth opening 174 (i.e., the upper openings). The second set of openings 175-179 includes a second opening 175, a fourth opening 176, a sixth opening 177, an eighth opening 178, and a tenth opening 179 (i.e., the lower openings). In particular, the five openings 170-174 are positioned between the inlet channels 141, 143, 145 and the outlet channels 152, 154, 156. Similarly, the five openings 175-179 are positioned between the inlet channels 142, 144, 146 and the outlet channels 151, 153, 155. Specifically, the first opening 170 is between the first inlet channel 141 and the second outlet channel 152, and the second opening 175 is between the second inlet channel 142 and the first outlet channel 151. In addition, the third opening 171 is between the third inlet channel 143 and the second outlet channel 152, and the fourth opening 176 is between the second inlet channel 142 and the third outlet channel 153. In other words, the openings 170-179 place an inlet channel 141-146 in fluid communication with an adjacent one of the outlet channels 151-156 (i.e., an outlet channel next to, but not aligned with the inlet channel). With reference to FIG. 4, the third opening 171 is aligned with the first opening 170 along an upper opening axis 167. Also, the fourth opening 176 is aligned with the second opening 175 along a lower opening axis 168. In the illustrated embodiments, the upper openings 170-174 are all aligned along the upper opening axis 167, and the lower opening 175-179 are all aligned along the lower opening axis 168.

With continued reference to FIGS. 4-9, the mixer element 136 can alternatively be described as including five wave wall segments 181-185 (i.e., wave segments, wall segments). The first wave segment 181 includes a first guide wall 190, a second guide wall 192, and a first dividing wall 191 extending between the first guide wall 190 and the second guide wall 192. The upstream contour (i.e., inlet contour) of the wave segments 181-185 of the mixer element 136 is illustrated in FIG. 5 with dashed lines. Likewise, the downstream contour (i.e., outlet contour) of the wave segments 181-185 the mixer element 136 is illustrated in FIG. 7 with dashed lines.

The inlet channels 141-146 and the outlet channels 151-156 can alternatively be described as inlet chambers 141-146 and outlet chambers 151-156, and are referenced with the same reference numerals accordingly. For example, the first inlet chamber 141 is partially defined by the first guide wall 190 and the first dividing wall 191. The first outlet chamber 151 is also partially defined by the first guide wall 190 and the first dividing wall 191. In other words, the first outlet chamber 151 is positioned on an opposite side of the first guide wall 190 as the first inlet chamber 141 (i.e., the first guide wall 190 separates the first inlet chamber 141 and the first outlet chamber 151). In the illustrated embodiment, when the mixer element 136 is positioned with the housing 104, the first guide wall 190 completely separates the first inlet chamber 141 and the first outlet chamber 151 such that the first inlet chamber 141 is not in fluid communication with the first outlet chamber 151. The second inlet chamber 142 is partially defined by the second guide wall 192 and the first dividing wall 191. The second outlet chamber 152 is partially defined by the second guide wall 192 and the first dividing wall 191. As before, the second outlet chamber 152 is positioned on an opposite side of the second guide wall 192 as the second inlet chamber 142 (i.e., the second guide wall 192 separates the second inlet chamber 142 and the second outlet chamber 152).

With continued reference to FIGS. 4-9, the first opening 170 is at least partially defined by the first dividing wall 191. The first opening 170 places the first inlet chamber 141 in fluid communication with the second outlet chamber 152. The second opening 175 is at least partially defined by the first dividing wall 191. The second opening 175 places the second inlet chamber 142 in fluid communication with the first outlet chamber 151. In the illustrated embodiment, an outer periphery of the first dividing wall 191 at least partially defines the first opening 170 and at least partially defines the second opening 175.

Similar to the first wave segment 181, the second wave segment 182 includes a third guide wall 193, a fourth guide wall 195, and a second dividing wall 194 extending between the first guide wall 193 and the fourth guide wall 195. Likewise, the third wave segment 183 includes a fifth guide wall 196, a sixth guide wall 198, and a third dividing wall 197 extending between the fifth guide wall 196 and the sixth guide wall 198. The fourth wave segment 184 includes a seventh guide wall 199, an eighth guide wall 201, and a fourth dividing wall 200 extending between the seventh guide wall 199 and the eighth guide wall 201. The fifth wave segment 185 includes a ninth guide wall 202, a tenth guide wall 204, and a fifth dividing wall 203 extending between the ninth guide wall 202 and the tenth guide wall 204. As illustrated in FIGS. 5 and 7, the wave segments 181-185 form a uninterrupted outline at the upstream end of the mixer element 136 (FIG. 5) and at the downstream end of the mixer element 136 (FIG. 7) as formed by the guide walls 190, 192, 193, 195, 196, 198, 199, 201, 202, 204 and the dividing walls 191, 194, 197, 200, 203.

As such, the second inlet chamber 142 is partially defined by the third guide wall 193. Likewise, the second outlet chamber 152 is partially defined by the third guide wall 193. In other words, in the illustrated embodiment, the third guide wall 193 is contiguous with the second guide wall 192. Likewise, the fifth guide wall 196 is contiguous with the fourth guide wall 195. The third inlet chamber 143 is partially defined by the fourth guide wall 195 and the second dividing wall 194. The third outlet chamber 153 is partially defined by the fourth guide wall 195 and the second dividing wall 194. The fourth and fifth inlet chambers 144, 145 and the fourth, and fifth outlet chambers 154, 155 are constructed similarly to the first, second, and third inlet and outlet chambers 141, 142, 143, 151, 152, 153 but not described herein for sake of brevity.

With continued reference to FIGS. 4-9, the third opening 171 is at least partially defined by the second dividing wall 194. The third opening 171 places the third inlet chamber 143 in fluid communication with the second outlet chamber 152. The fourth opening 176 is also at least partially defined by the second dividing wall 194. The fourth opening 176 places the second inlet chamber 142 in fluid communication with the third outlet chamber 153.

Figure 9:
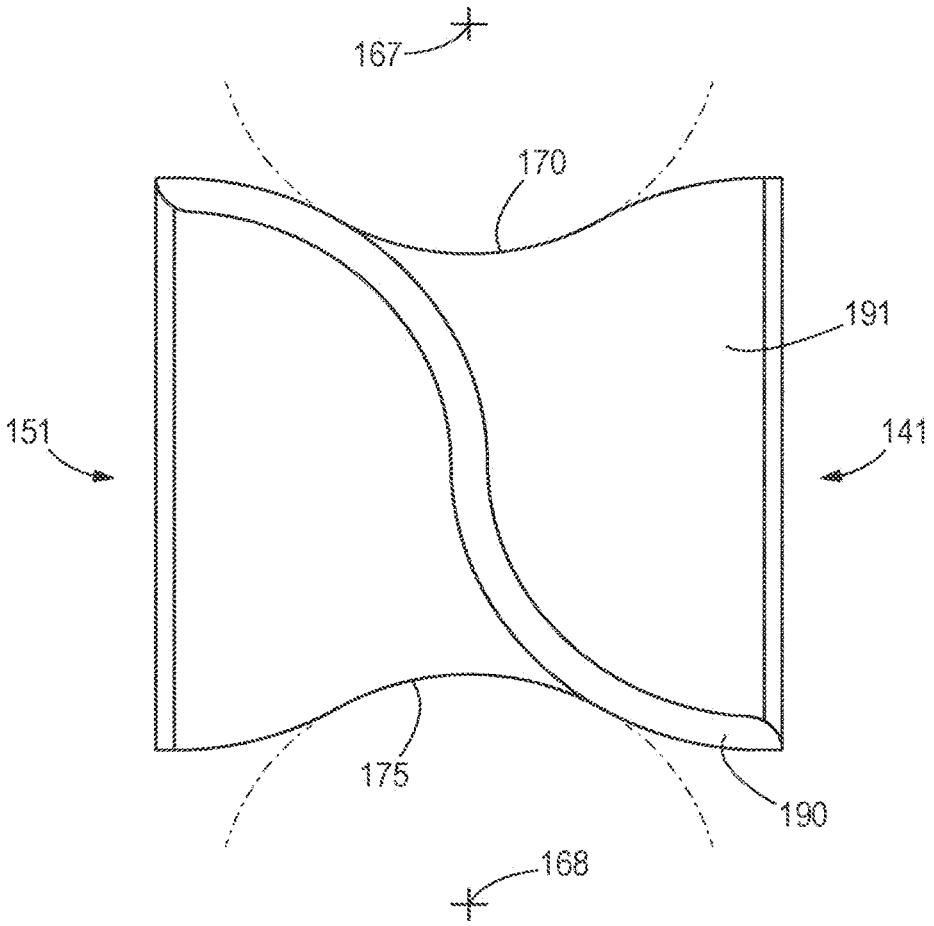
FIG. 9 is a side view of the mixer element of FIG. 4.

With reference to FIGS. 4, 5, and 7, the first dividing wall 191 and the second dividing wall 194 are parallel to each other. In the illustrated embodiment, each of the dividing walls 191, 194, 197, 200, 203 are parallel to each other. With reference to FIGS. 4 and 9, the first guide wall 190 is non-planar (i.e., a curved surface) and the second guide wall 192 is non-planar (i.e., a curved surface). In other words, the first guide wall 190 does not extend along a straight line (i.e., the first guide wall 191 is curve-shaped). Likewise, the second guide wall 192 does not extend along a straight line (i.e., the second guide wall 192 is curve-shaped). The other guide walls 193, 195, 196, 190, 199, 201, 202, 204 have a similar shape as the first and second guide walls 191, 192.

In operation, material entering the inlet channels 141-146 (i.e., inlet chambers) is guided by the guide walls 190, 192, 193, 195, 196, 198, 199, 201, 202, and 204 toward the openings 170-179. The material then passes from the inlet channels 141-146 through the openings 170-179 to the outlet channels 151-156. Specifically, the material flows from an inlet channel into an adjacent outlet channel through an opening. For example, material entering the inlet channel 141 is guided by the first guide wall 190 toward the first opening 170 where the material then enters the second outlet channel 152 (i.e., an outlet channel adjacent the inlet channel). As such, the first inlet channel 141 is not in fluid communication with the first outlet channel 151 and the second inlet channel 142 is not in fluid communication with the second outlet channel 152. Likewise, material entering the second inlet channel 142 is guided by the second guide wall 192 and the third guide wall 193 toward the second opening 175 and the fourth opening 176 where the material then enters the first outlet channel 151 and the third outlet channel 153. In the illustrated embodiment, the first inlet chamber 141 is partially defined by the housing 104. In particular, two chamber walls 132 bound the first inlet chamber 141 (i.e., the first inlet channel). The second inlet chamber 142 is only bound by a single chamber wall 132. In alternative embodiments, at least one of the guide walls (e.g., the first guide wall 190) may be formed as part of the housing 104, and more specifically as part of the chamber walls 132.

Figure 10:
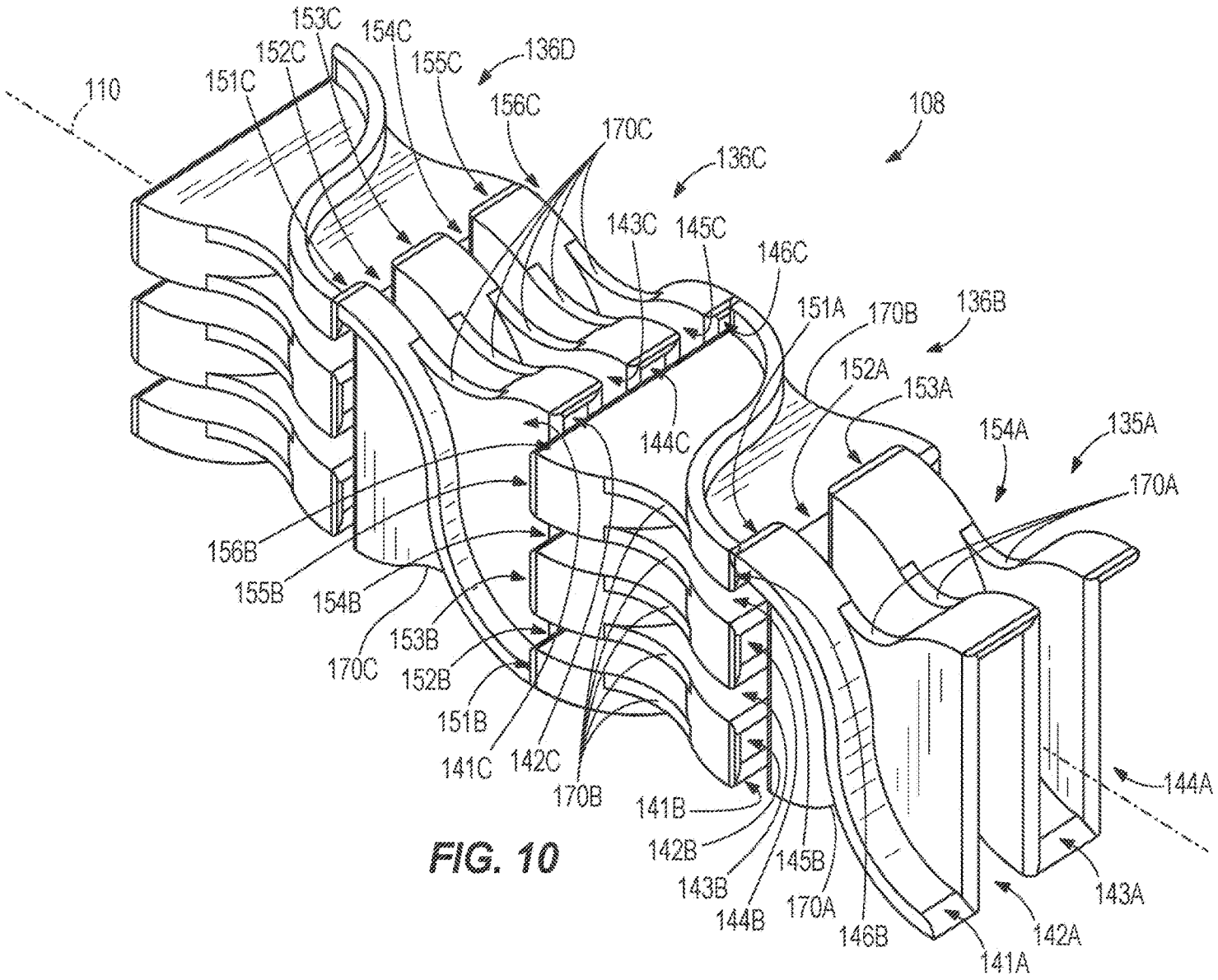
FIG. 10 is a perspective view of the mixer assembly of FIG. 3.
Figure 11:
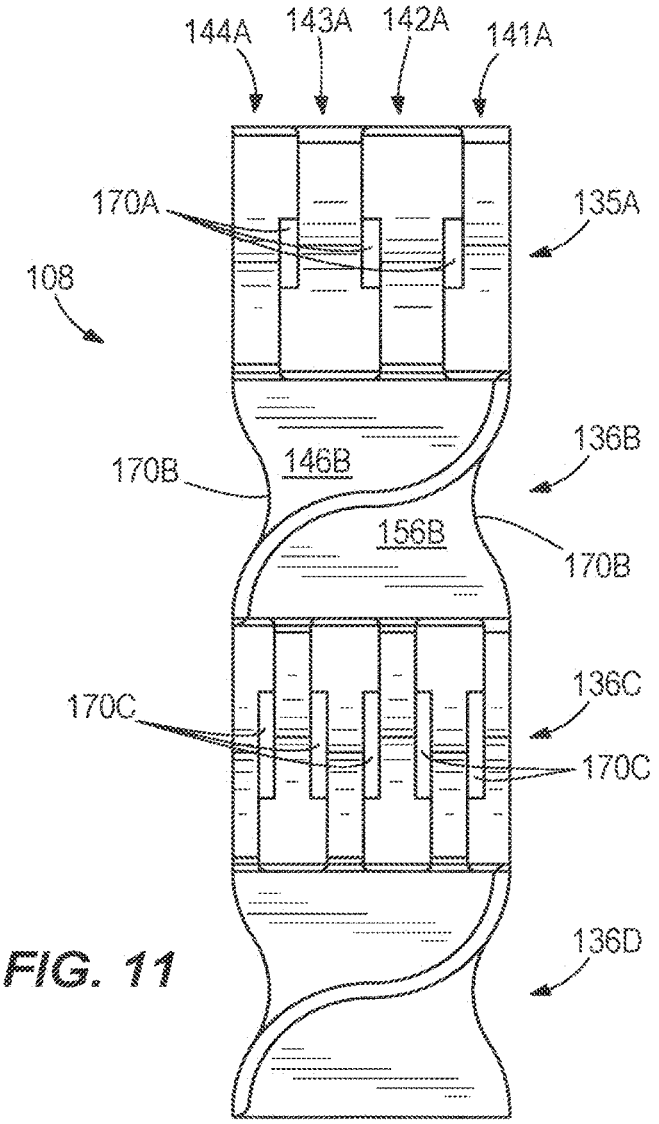
FIG. 11 is a top view of the mixer assembly of FIG. 10.
Figure 12:
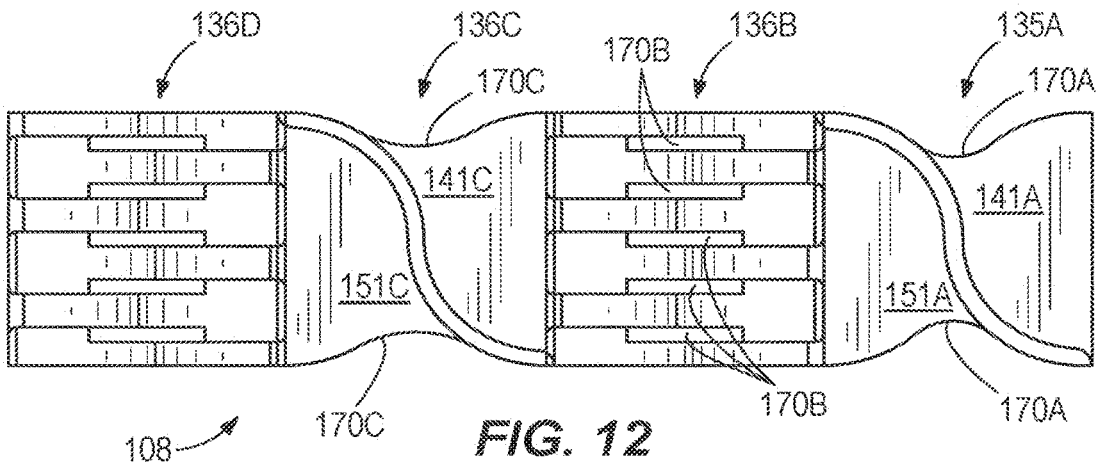
FIG. 12 is a side view of the mixer assembly of FIG. 10.

With reference to FIGS. 10-12, the mixer assembly 108 is illustrated with four mixer elements 135A, 136B, 136C, 136D. Specifically, the mixer assembly 108 includes a first mixer element 135A, a second mixer element 136B, a third mixer element 136C, and a fourth mixer element 136D. The second mixer element 136B is positioned downstream in the material flow path from the first mixer element 135A. The third mixer element 136C is positioned downstream in the material flow path from the second mixer element 136B. The fourth mixer element 136D is positioned downstream in the material flow path from the third mixer element 136C. In the illustrated embodiment, the four mixer element 135A, 136B, 136C, 136D are formed as a single integral unit (i.e., formed with an injection molding process).

In the embodiment illustrated in FIGS. 10-12, the second, third, and, fourth mixer elements 136B, 136C, 136D are the same structure illustrated for the mixer element 136 of FIGS. 4-9. However, the third mixer element 136C is positioned in a different orientation as the second mixer element 136B and the fourth mixer element 136D is positioned in a different orientation as the third mixer element 136C. In other words, the mixer assembly 108 defines a longitudinal axis 110 and the mixer elements 135A, 136B, 136C, 136D are positioned in different orientations rotationally about the longitudinal axis 110. For example, the second mixer element 136B is oriented with a 90 degree rotation along the longitudinal axis 110 with respect to the first mixer element 135A, and the third mixer element 136C is oriented with a 90 degree rotation along the longitudinal axis 110 with respect to the second mixer element 136B.

Similar to the description above with respect to the single mixer element 136 of FIGS. 4-9, the first mixer element 135A includes a plurality of primary inlet channels 141A-144A and a plurality of primary outlet channels 151A-154A. Similarly, the second mixer element 136B includes a plurality of secondary inlet channel 141B-146B and a plurality of second outlet channels 151B-156B. The first mixer element 135A is similar to the second mixer element 136B, but the first mixer element 135A includes four inlet channels 141A-144A and four outlet channels 151A-154A as compared to the six inlet channels 141B-146B and six outlet channels 151B-156B of the second mixer element 136B. In other words, the number of primary inlet channels 141A-144A does not equal the number of secondary inlet channels 141B-146B. Likewise, the number of primary outlet channels 151A-154A does not equal the number of secondary inlet channels 141B-146B. In the illustrated example, the number of primary inlet channels is four, the number of primary outlet channels is four, and the number of secondary inlet channels is six. As described in greater detail below, a mixer assembly may include any number of or and type of mixer elements described herein (e.g., 1 mixer element, 2 mixer elements, 4 mixer elements, 5 mixer elements, 10 mixer elements, 15 mixer elements, 20 mixer elements, etc.).

A plurality of primary stage openings 170A in the first mixer element 135A are positioned similarly to that described for the openings 170-179 of the single mixer element 136 of FIGS. 4-9. In particular, each of the plurality of primary openings 170A connects at least one of the plurality of primary inlet channels 141A-144A with at least one of the plurality of primary outlet channels 151A-154A adjacent the at least one of the plurality of primary inlet channels 141A-144A. In other words, each primary opening 170A is positioned between a primary inlet channel (e.g., 141A) and at least one adjacent primary outlet channel (e.g., 152A). Similarly, each of the plurality of secondary openings 170B connects at least one of the plurality of secondary inlet channels 141B-146B with at least one of the plurality of secondary outlet channels 151B-156B adjacent the at least one of the plurality of secondary inlet channels 141B-146B. In other words, each secondary opening 170B is positioned between a secondary inlet channel (e.g., 142B) and at least one adjacent secondary outlet channel (e.g., 151B and 153B).

Likewise, with continued reference to FIGS. 10-12, the third mixer element 136C is positioned downstream in the material flow path from the second mixer element 136B. The third mixer element 136 includes a plurality of tertiary inlet channels 141C-146C and a plurality of tertiary outlet channels 151C-156C. A plurality of tertiary openings 170C in the third mixer element 136C are positioned similarly to that described for the openings 170-179 of the single mixer element 136 of FIGS. 4-9. In particular, each of the plurality of tertiary openings 170C connects at least one of the plurality of tertiary inlet channels 141C-146C with at least one of the plurality of tertiary outlet channels 151C-156C adjacent the at least one of the plurality of inlet channels 141C-146C. In other words, each tertiary opening 170C is positioned between a tertiary inlet channel (e.g., 143C) and at least one adjacent tertiary outlet channel (e.g., 152C and 154C).

With continued reference to FIGS. 10-12, the second mixer element 136B is oriented such that the plurality of secondary inlet channels 141B-146B extend approximately perpendicular (e.g., between approximately 80 degrees and approximately 100 degrees) to the plurality of primary outlet channels 151A-154A. Likewise, the third mixer element 136C is oriented such that the plurality of tertiary inlet channels 141C-146C extend approximately perpendicular to the plurality of secondary outlet channels 151B-156B. In alternative embodiments, the inlet channels of a downstream mixer element may extend generally transverse (but not exactly perpendicular) to the upstream outlet channels.

In operation, with the mixer assembly 108 positioned within the housing 104 as shown in FIGS. 2 and 3, the mixer assembly 108 receives material at the primary inlet channels 141A-146A. The material then passes through each successive mixer element as described above with respect to the operation of the mixer element 136 of FIGS. 4-9. In other words, material passes from an inlet channel, through an opening, to an adjacent outlet channel in each of the mixer elements. The partially-mixed mixture exiting the outlet channels of an upstream mixer element (e.g., mixer element 135A) is then received by the inlet channels of the downstream mixer element (e.g., mixer element 136B), and so forth. Once the material has passed through each of the mixer elements 135A, 136B, 136C, 136D, the material exits the nozzle 124 of the housing 104 as a homogenous mixture.

The mixer assembly 108 is illustrated with a 3-wave mixer element (i.e., mixer element 135A) followed by three 5-wave mixer elements downstream (i.e., mixer elements 136B, 136C, 136D). Each of the mixer elements 135A, 136B, 136C, 136D includes curved guide walls. However, alternative mixer assemblies are considered herein including alternative mixer elements and combinations thereof. Examples of such alternative mixer elements are discussed below.

Figure 13:
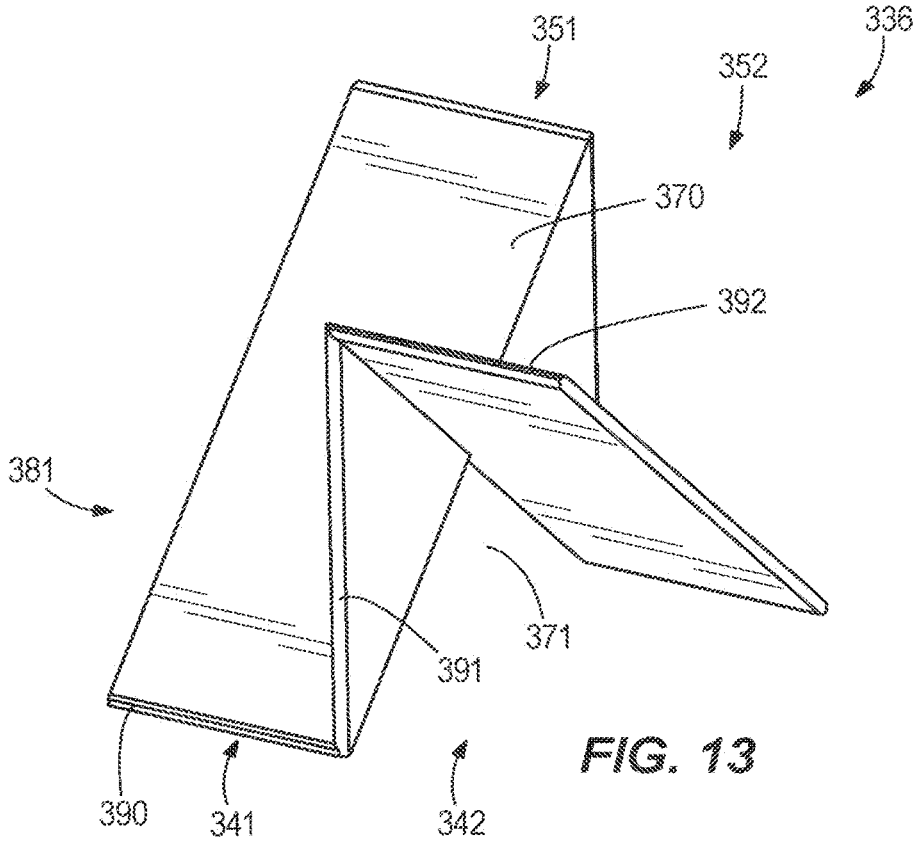
FIG. 13 is a perspective view of a mixer element according to another aspect of the invention.
Figure 14:
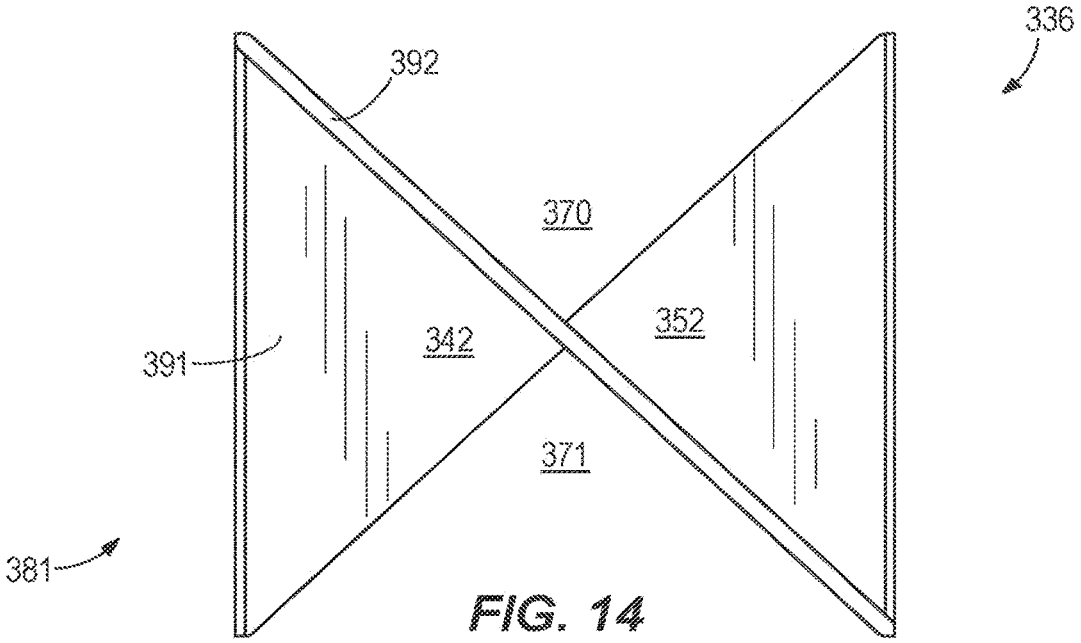
FIG. 14 is a side view of the mixer element of FIG. 13.

With reference to FIGS. 13-14, a single left wave mixer element 336 is illustrated. The mixer element 336 is an example of an alternative mixer element that can be utilized in a static mixer by itself or in combination with any other mixer element. The mixer element 336 includes a first wave wall segment 381 including a first guide wall 390, a second guide wall 392, and a dividing wall 391 extending between the first guide wall 390 and the second guide wall 392. A first inlet chamber 341 is partially defined by the first guide wall 390 and the dividing wall 391. A first outlet chamber 351 is partially defined by the first guide wall 390 and the dividing wall 391. A second inlet chamber 342 is partially defined by the second guide wall 392 and the dividing wall 391. A second outlet chamber 352 is partially defined by the second guide wall 392 and the dividing wall 391. A first opening 370 is at least partially defined by the dividing wall 391 and places the first inlet chamber 341 in fluid communication with the second outlet chamber 352. A second opening 371 is at least partially defined by the dividing wall 391 and places the second inlet chamber 342 in fluid communication with the first outlet chamber 351.

The mixer element 336 of FIGS. 13-14 is similar to the mixer element 136 but includes the following differences. The mixer element 336 includes a single wave wall segment 381 (as opposed to five wave wall segments 181-185). The first guide wall 390 and the second guide wall 392 are planar (i.e., linear surfaces). In addition, the first opening 370 and the second opening 371 are triangular-shaped with no flange portion extending from the dividing wall 391 into the openings 370, 371.

Figure 15:
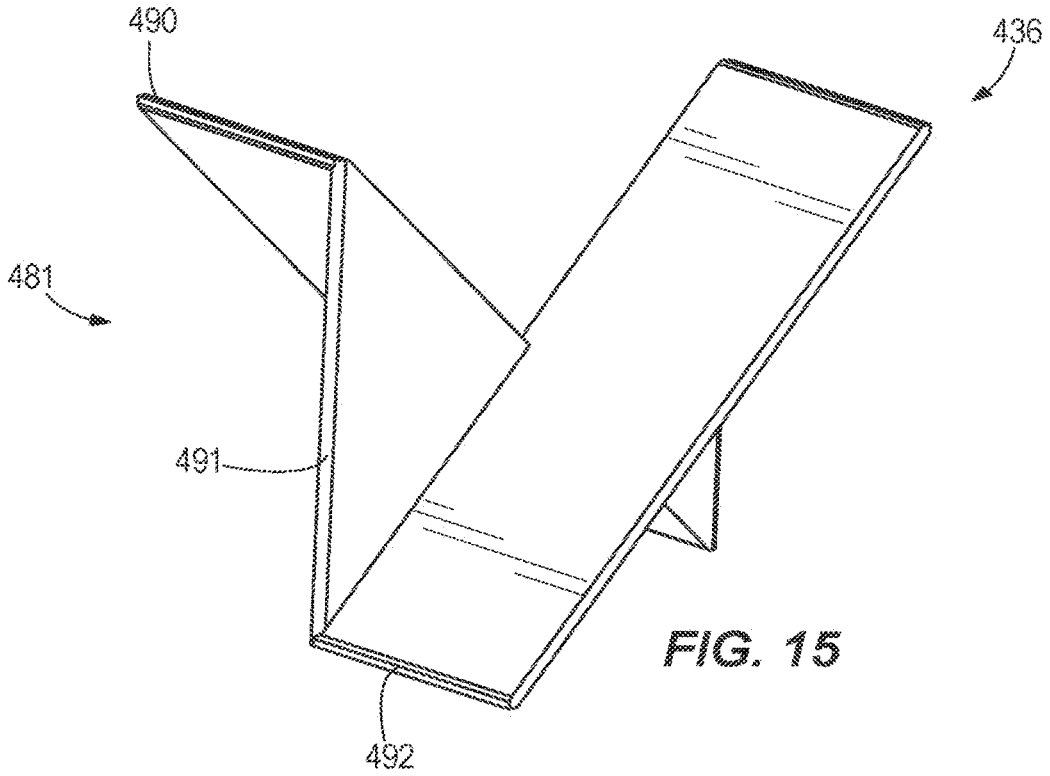
FIG. 15 is a perspective view of a mixer element according to another aspect of the invention.

With reference to FIG. 15, an alternative mixer element is illustrated as a single right wave mixer element 436. The mixer element 436 is an example of an alternative mixer element that can be utilized in a static mixer by itself or in combination with any other mixer element. The mixer element 436 includes a first wave wall segment 481 including a first guide wall 490, a second guide wall 492, and a dividing wall 491 extending between the first guide wall 490 and the second guide wall 492.

The mixer element 436 of FIG. 15 is similar to the mixer element 336 but includes the following differences. The mixer element 436 is configured such that the first guide wall 490 extends top to bottom, as viewed from FIG. 15 (as opposed to the first guide wall 390 extending bottom to top). In other words, the mixer element 436 of FIG. 15 is identical to the mixer element 336 of FIGS. 13-14 except that the mixer element 436 of FIG. 15 is reoriented (i.e., 180 degrees). Similar 180 degree reorientations (FIG. 13 to FIG. 15) are considered for all of the mixer elements disclosed herein.

Figure 16:
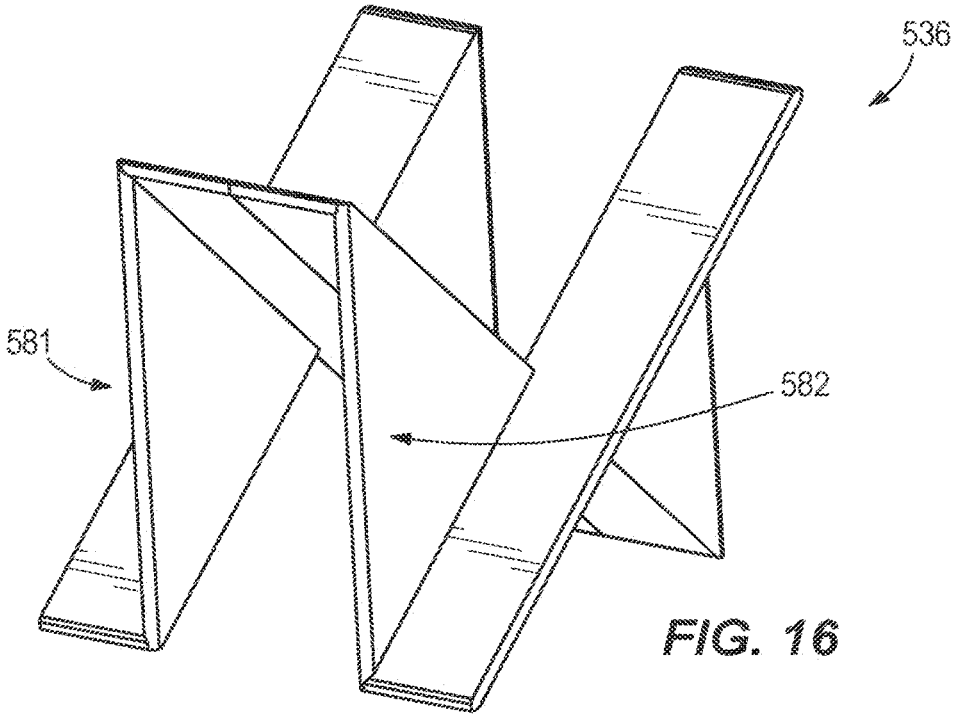
FIG. 16 is a perspective view of a mixer element according to another aspect of the invention.
Figure 17:
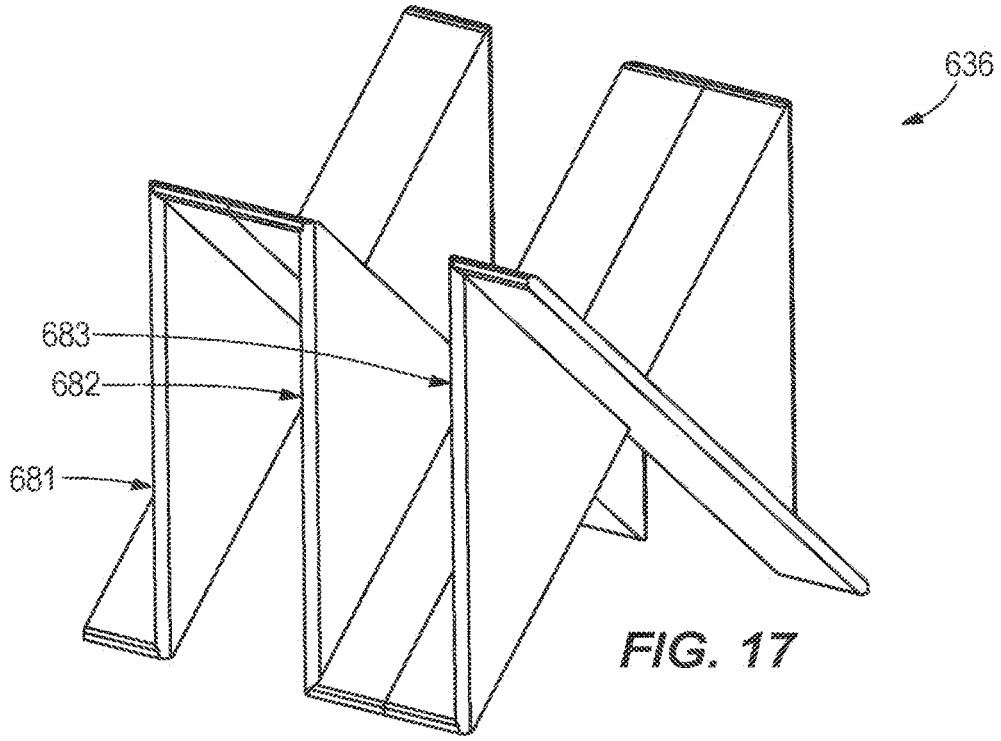
FIG. 17 is a perspective view of a mixer element according to another aspect of the invention.
Figure 18:
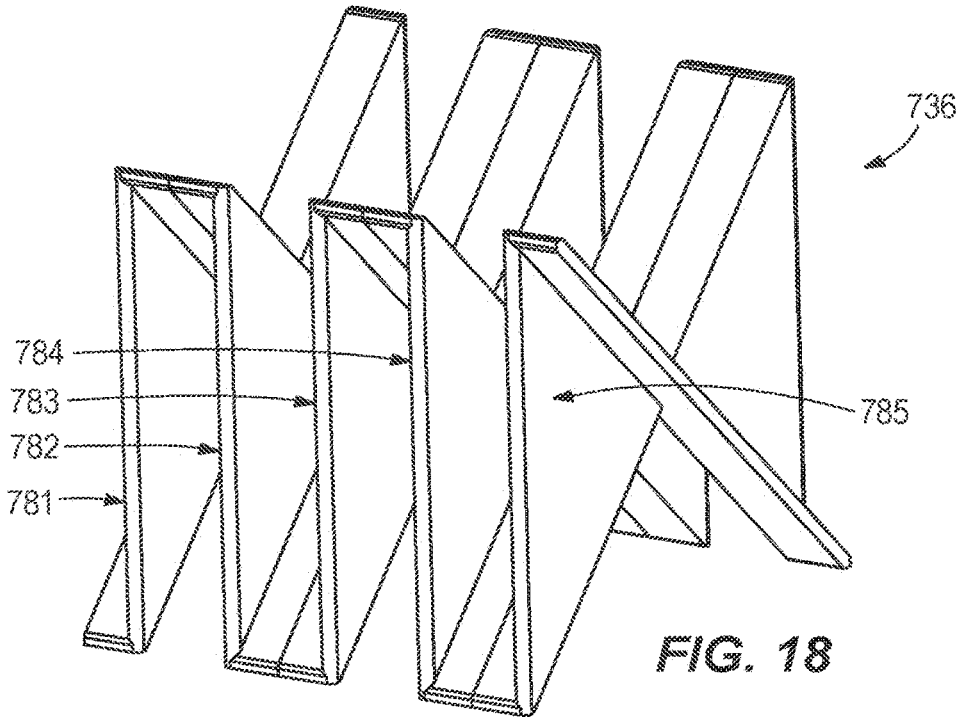
FIG. 18 is a perspective view of a mixer element according to another aspect of the invention.

With reference to FIG. 16, an alternative mixer element is illustrated as a two wave mixer element 536. The mixer element 536 is an example of an alternative mixer element that can be utilized in a static mixer by itself or in combination with any other mixer element. The mixer element 536 is similar to the mixer element 336 but includes two wave wall segments 581-582 (as opposed to a single wave wall segment 381). In other words, the mixer element 536 is the combination of the mixer element 336 (i.e., the left hand single wave mixer) with the mixer element 436 (i.e., the right hand single wave mixer). Similar combinations of single wave wall segments can but utilize to create, for example, a three wave mixer element 636 (FIG. 17) or a five wave mixer element 736 (FIG. 18). In particular, the mixer element 636 includes three wave wall segments 681-683, and the mixer element 736 includes five wave wall segments 781-785. This method of utilizing any number of wave wall segments (FIGS. 13, 16, 17, and 18) also applies for any alternative mixer element geometry described herein. As demonstrated by FIGS. FIGS. 13-18, a mixer element may include any number of wave wall segments in any orientation. In other words, for any of the alternative wave wall segment geometry described herein, that geometry can be replicated to create multiple wave mixer elements.

Figure 1:
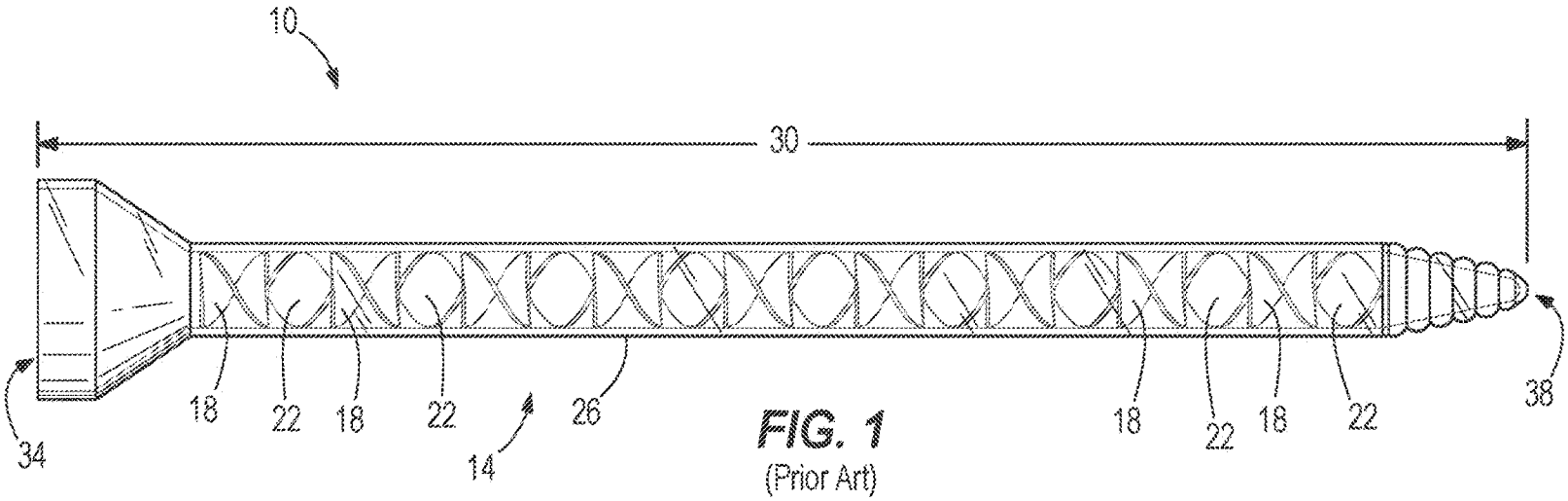
FIG. 1 (Prior Art)
FIG. 1 is a side view of a conventional static mixer.
Figure 19:
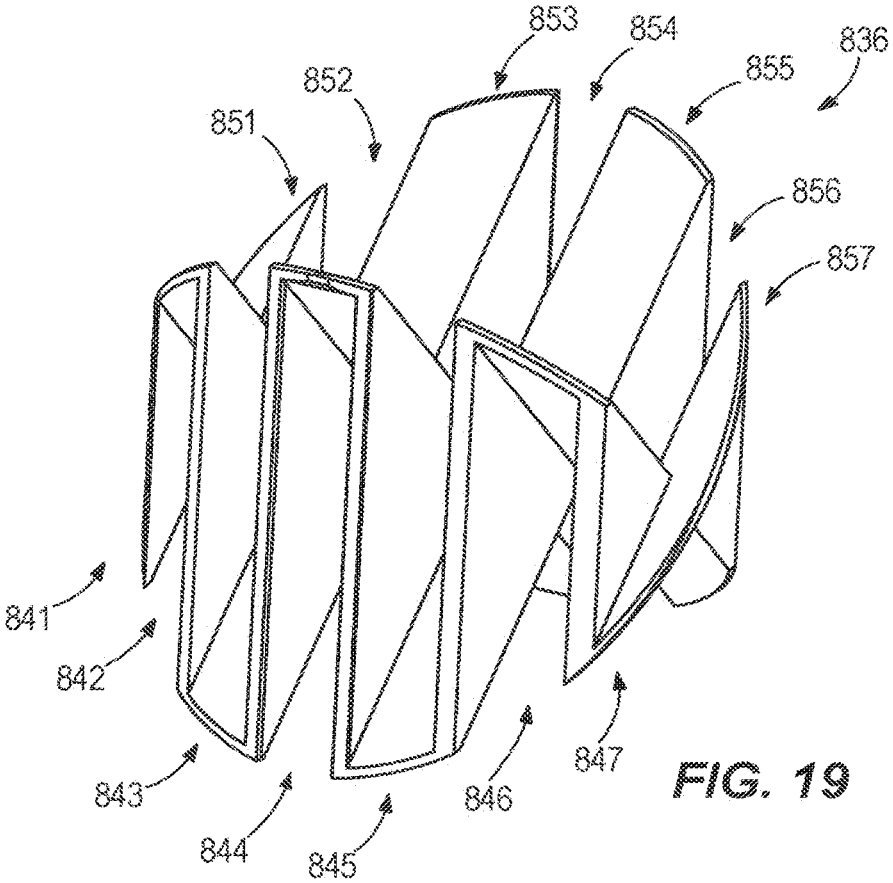
FIG. 19 is a perspective view of a mixer element according to another aspect of the invention.
Figure 20:
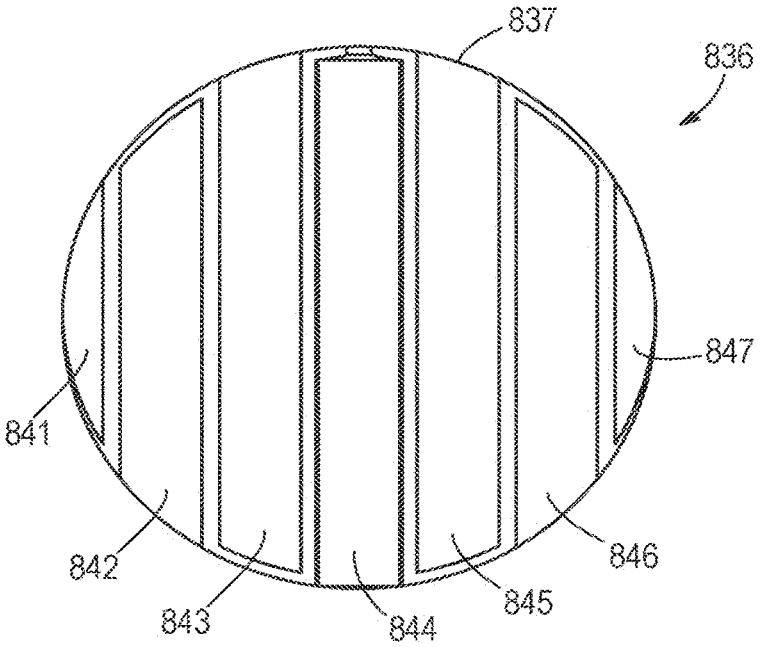
FIG. 20 is a front view of the mixer element of FIG. 19.
Figure 21:
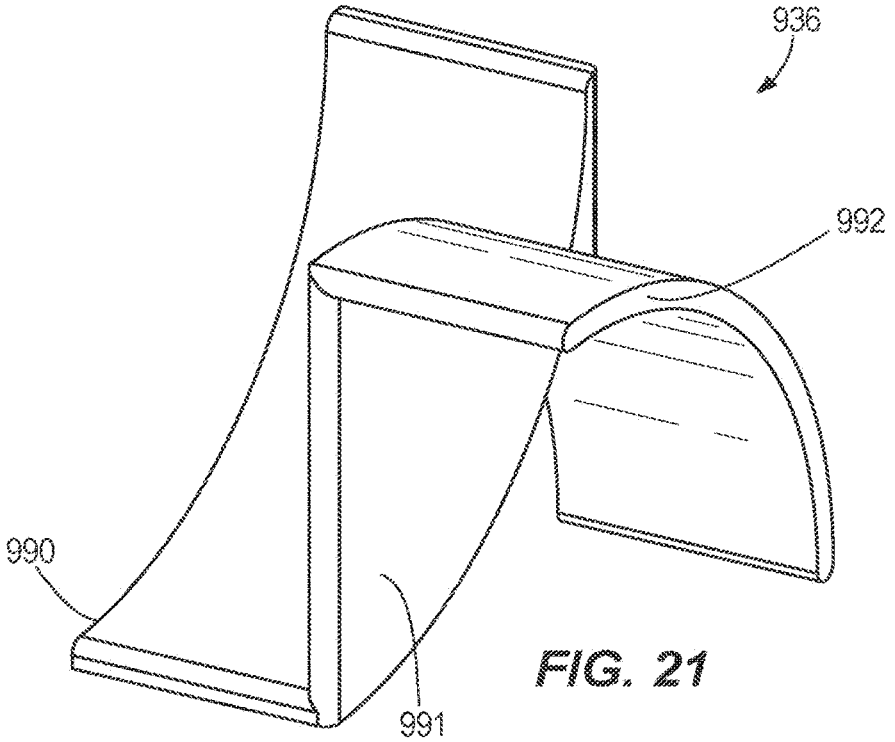
FIG. 21 is a perspective view of a mixer element according to another aspect of the invention.

With reference to FIGS. 19-20, an alternative mixer element is illustrated as a circular mixer element 836. Specifically the circular mixer element 836 includes seven inlet channels 841-847 and seven outlet channels 851-857 (i.e., a six wave wall segment design). As shown in FIG. 20, an outer periphery 837 of the mixer element 836 is circular. The circular-shape of the mixer element 836 is an alternative to the square or rectangular shaped mixer elements (e.g., mixer element 136). In other words, the circular mixer element 836 would be utilized with a corresponding circular housing (similar to housing 26 of FIG. 1).

Figure 22:
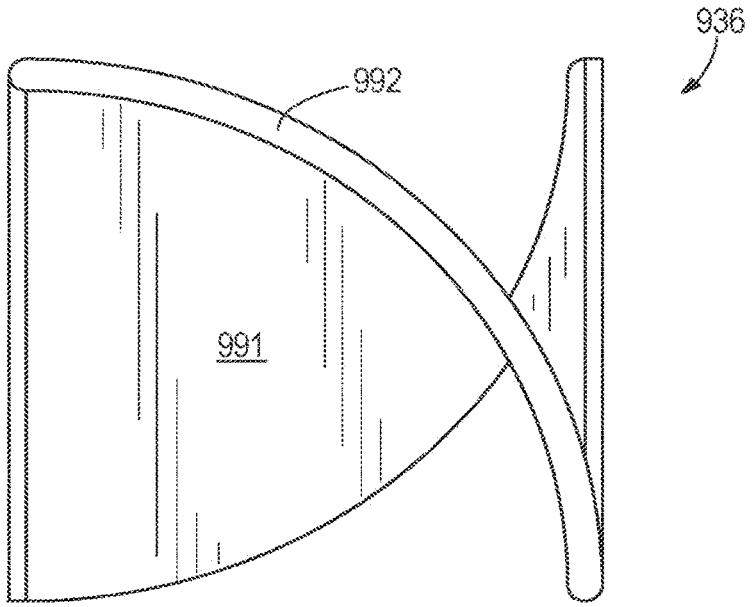
FIG. 22 is a side view of the mixer element of FIG. 21.

With reference to FIGS. 21-28, various alternative guide wall shapes are illustrated. Specifically, with reference to FIGS. 21-22, a mixer element 936 is illustrated with exponentially-shaped guide walls 990, 992 formed on both sides of a dividing wall 991. In other words, the guide walls 990, 992 are exponentially-shaped when viewed transverse to the dividing wall 991 (FIG. 22).

Figure 23:
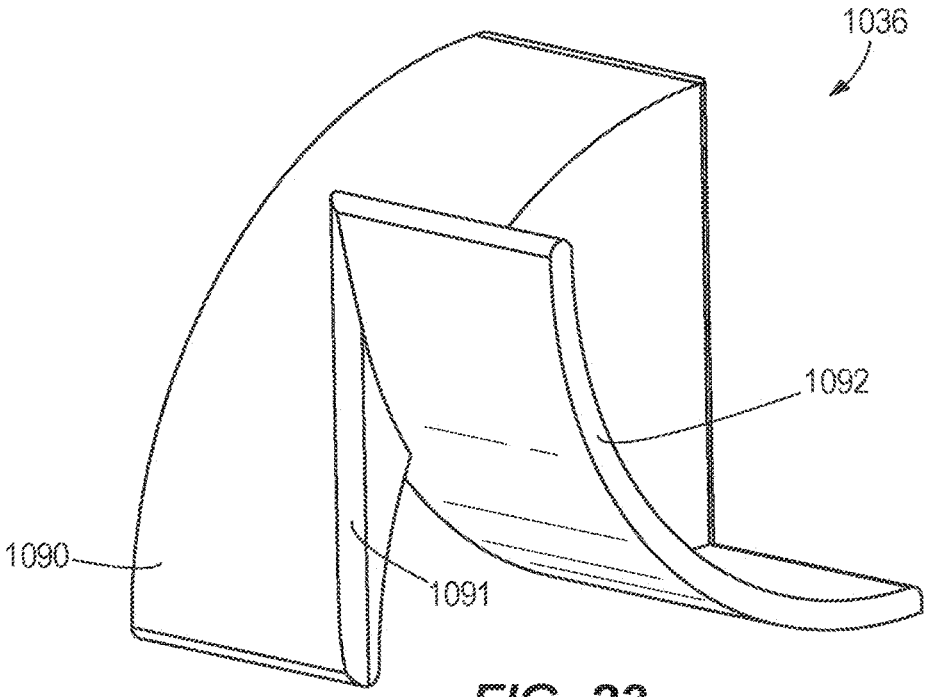
FIG. 23 is a perspective view of a mixer element according to another aspect of the invention.
Figure 24:
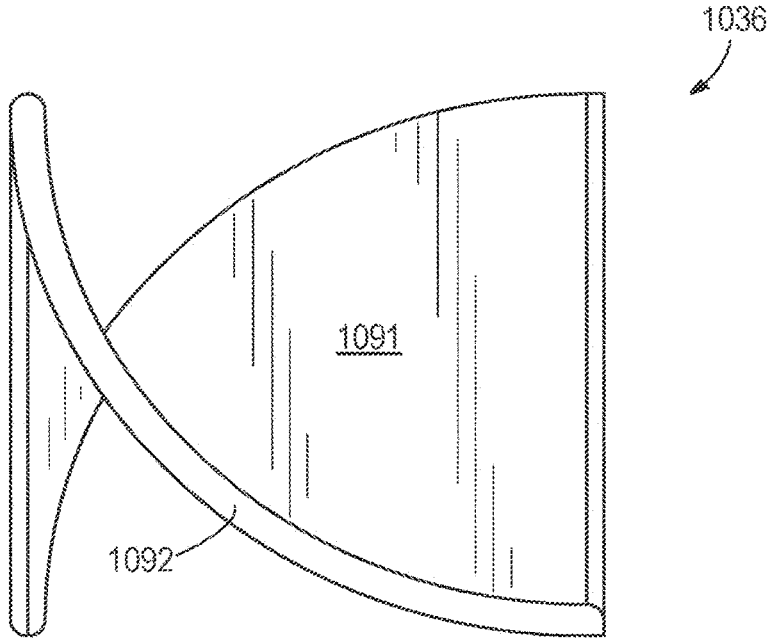
FIG. 24 is a side view of the mixer element of FIG. 23.

Similarly, with reference to FIGS. 23-24, a mixer element 1036 is illustrated with logarithm-shaped guide walls 1090, 1092 formed on both sides of a dividing wall 1091. In other words, the guide walls 1090, 1092 are logarithmically shaped when viewed transverse to the dividing wall 1091 (FIG. 24).

Figure 25:
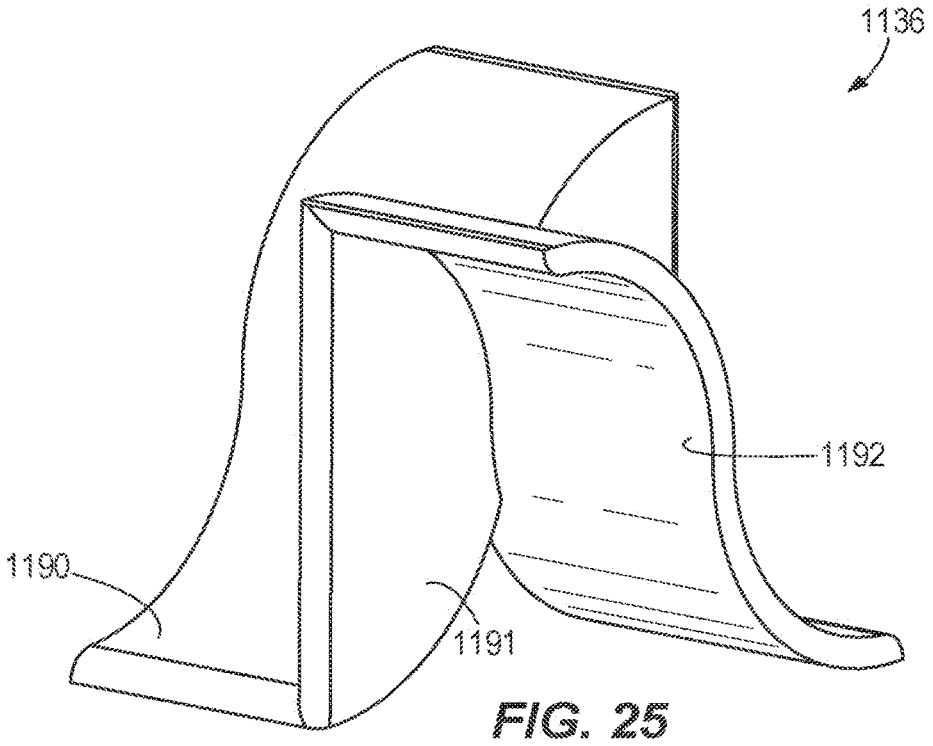
FIG. 25 is a perspective view of a mixer element according to another aspect of the invention.
Figure 26:
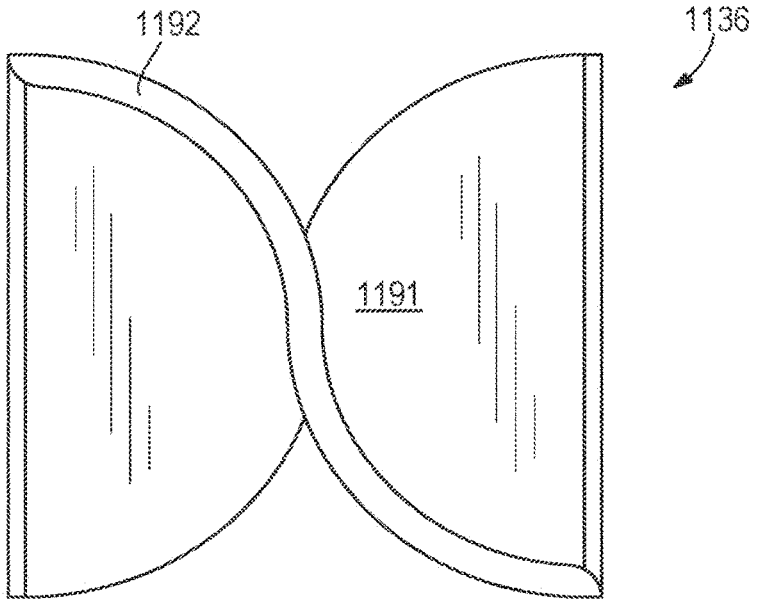
FIG. 26 is a side view of the mixer element of FIG. 25.

Similarly, with reference to FIGS. 25-26, a mixer element 1136 is illustrated with sigmoid-shaped guide walls 1190, 1192 formed on both sides of a dividing wall 1191. In other words, the guide walls 1190, 1192 are S-shaped when viewed transverse to the dividing wall 1191 (FIG. 26).

Figure 27:
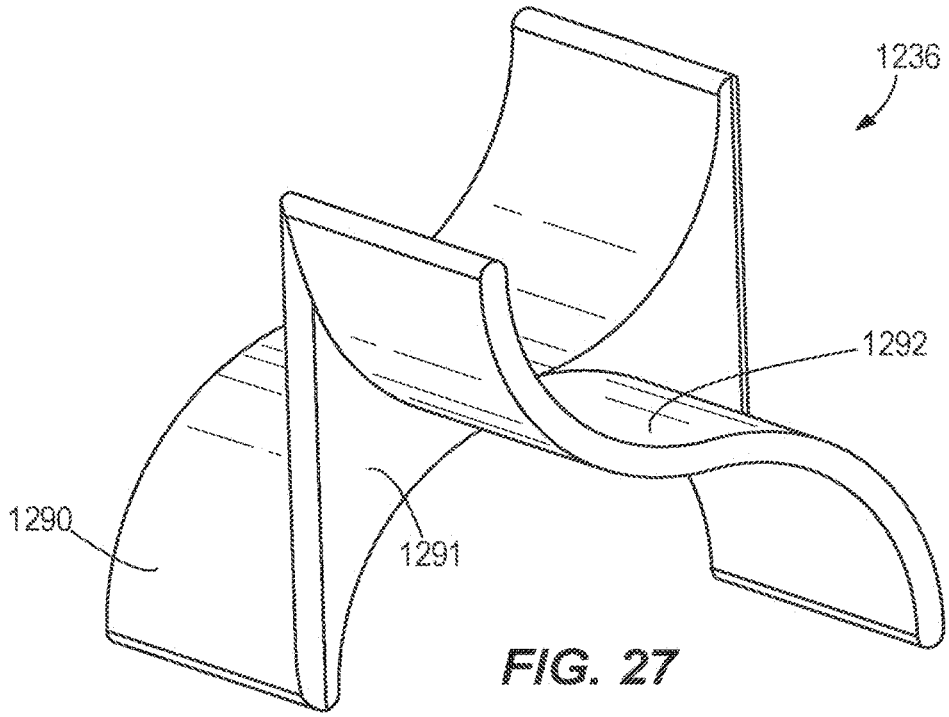
FIG. 27 is a perspective view of a mixer element according to another aspect of the invention.
Figure 28:
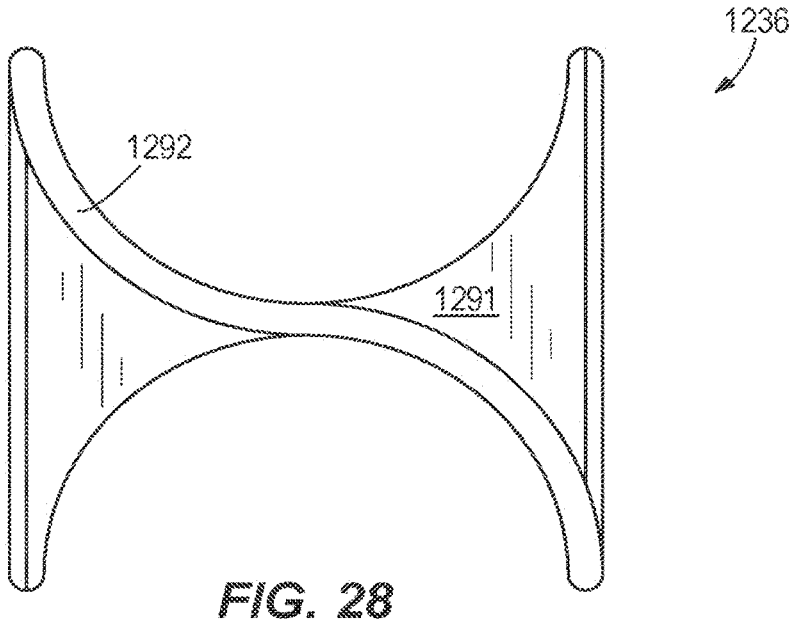
FIG. 28 is a side view of the mixer element of FIG. 27.

With reference to FIGS. 27-28, a mixer element 1236 is illustrated with sigmoid-shaped guide walls 1290, 1292 formed on both sides of a dividing wall 1291. In other words, the guide walls 1290, 1292 are S-shaped when viewed transverse to the dividing wall 1291 (FIG. 28). The mixer element 1236 is similar to the mixer element 1136 in that they both include S-shaped guide walls, with the difference being the orientation of the S-shaped guide walls when viewed transverse to the dividing wall (FIGS. 26 and 28). Although alternative guide wall geometry and shapes have been described with reference to FIG. 21-28, further alternative guide wall shapes are considered.

With reference to FIGS. 29-48, various alternative dividing wall shapes are illustrated. In particular, various alternative dividing walls including alternative flange shapes are illustrated in FIGS. 29-48. Specifically, with reference to FIGS. 29-30, a mixer element 1336 is illustrated with a dividing wall 1391 including large concave-shaped openings 1370. Specifically, the large concave-shaped opening 1370 may include a radius 1371.

Figure 29:
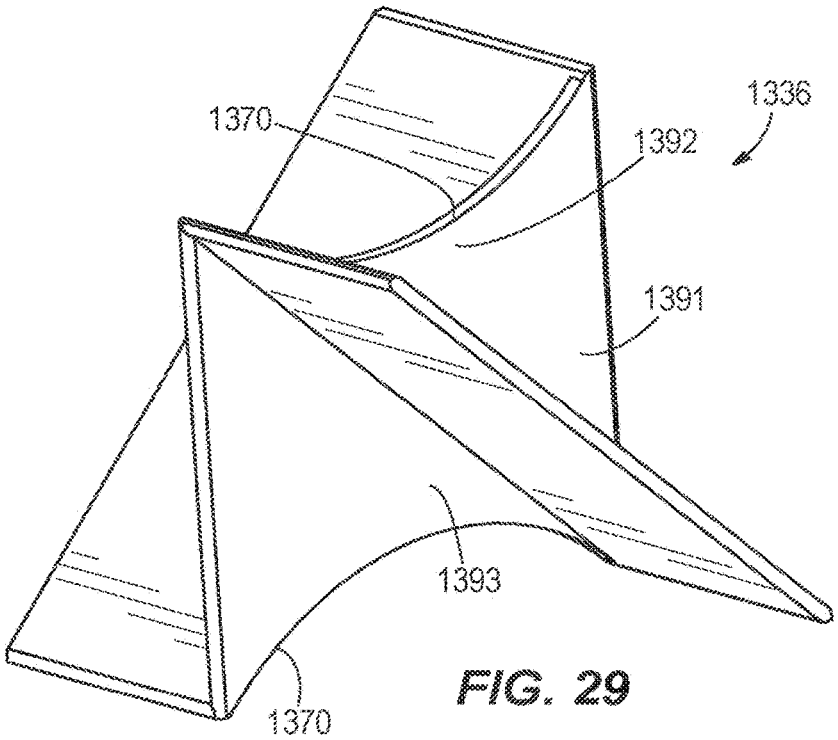
FIG. 29 is a perspective view of a mixer element according to another aspect of the invention.
Figure 30:
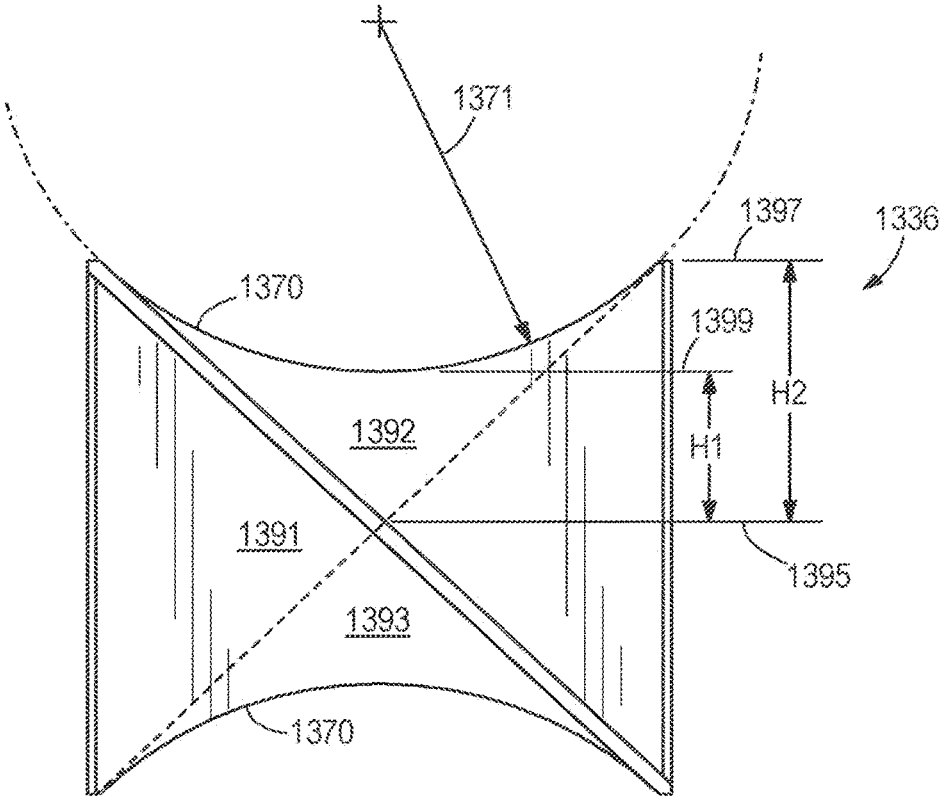
FIG. 30 is a side view of the mixer element of FIG. 29.

With continued reference to FIGS. 29-30, the dividing wall 1391 can be described as including an upper flange portion 1392 and a lower flange portion 1393. The flange portions 1392 and 1393 are the portions the dividing wall 1391 that would otherwise not be between an inlet channel and an adjacent outlet channel. In other words, the flange portions 1392, 1393 are portions of the dividing wall 1391 that impede the flow of material through the openings 1370 from an inlet channel to an adjacent outlet channel. A distance H2 from a center 1395 of the mixer element 1336 to a top edge 1397 of the mixer element 1336 is illustrated in FIG. 30. A distance H1 is also illustrated as the distance from the center 1395 to a bottom 1399 of the opening 1370. The dimensionless ratio H1/H2 describes the size of the flange 1392. For example, the illustrated H1/H2 ratio in FIG. 30 is approximately 0.6.

Figure 31:
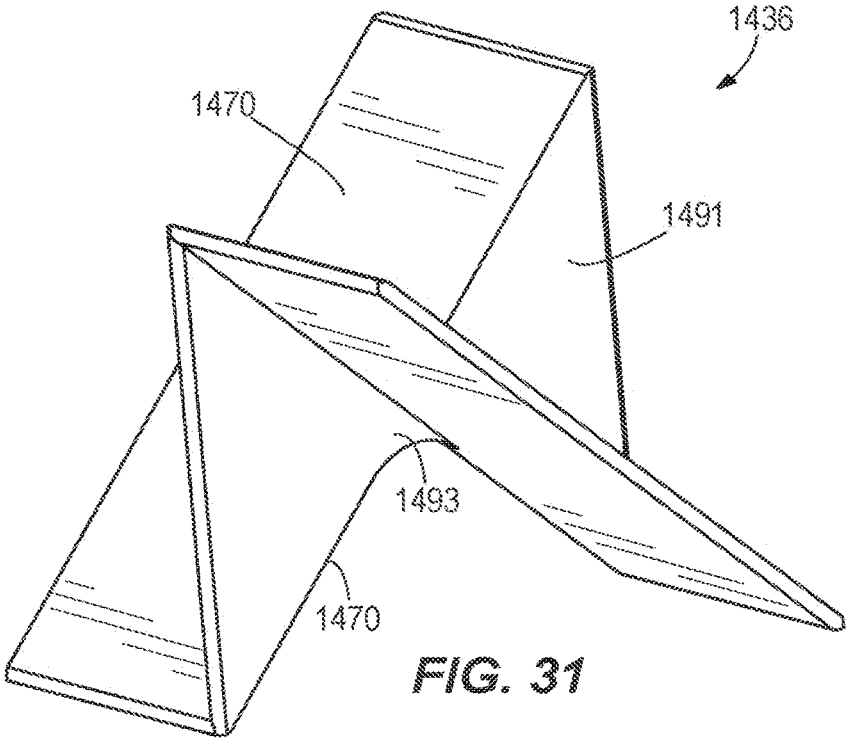
FIG. 31 is a perspective view of a mixer element according to another aspect of the invention.
Figure 32:
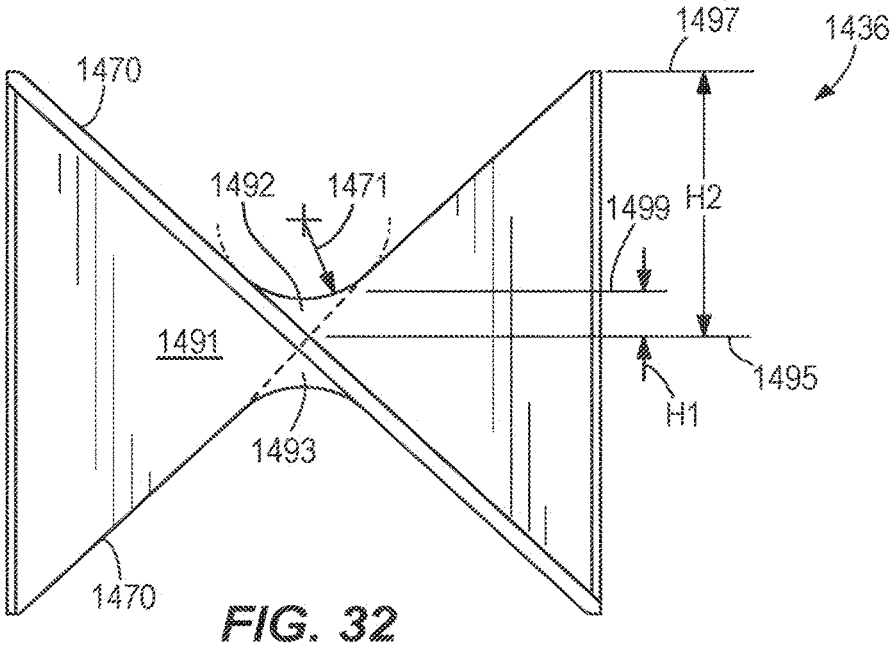
FIG. 32 is a side view of the mixer element of FIG. 31.

Similarly, with reference to FIGS. 31-32, a mixer element 1436 is illustrated with a dividing wall 1491 including small concave-shaped openings 1470. Specifically, the small concave-shaped opening 1470 may include a radius 1471. The dividing wall 1491 includes an upper flange portion 1492 and a lower flange portion 1493. Similar to the mixer element 1336 of FIG. 30, the mixer element 1436 includes a distance H2 from a center 1495 to a top edge 1497 and a distance H1 from the center 1495 to a bottom 1499 of the opening 1470. The H1/H2 ratio of FIG. 32 is approximately 0.1.

Figure 33:
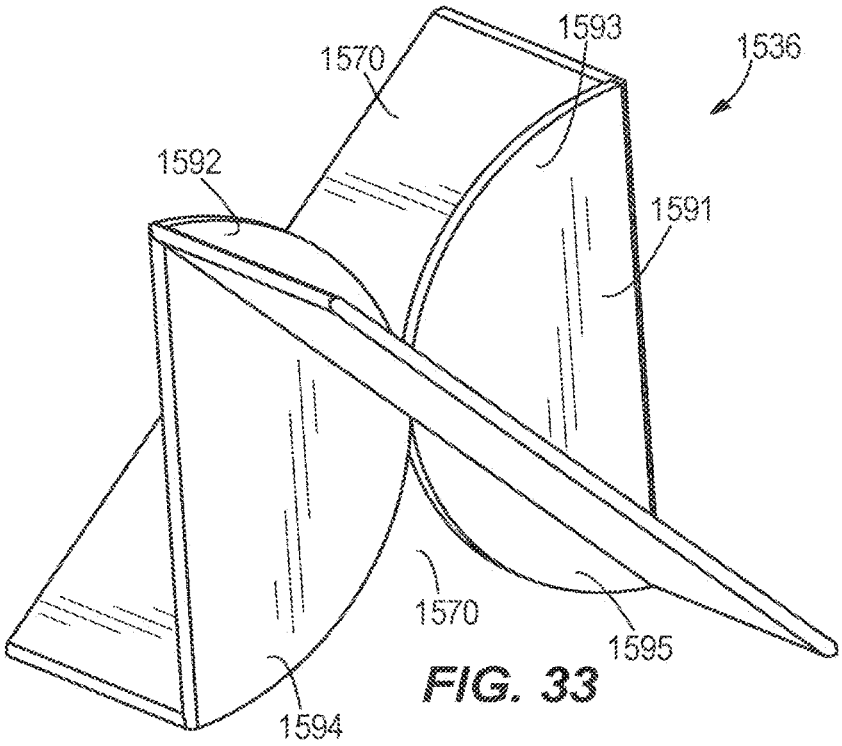
FIG. 33 is a perspective view of a mixer element according to another aspect of the invention.
Figure 34:
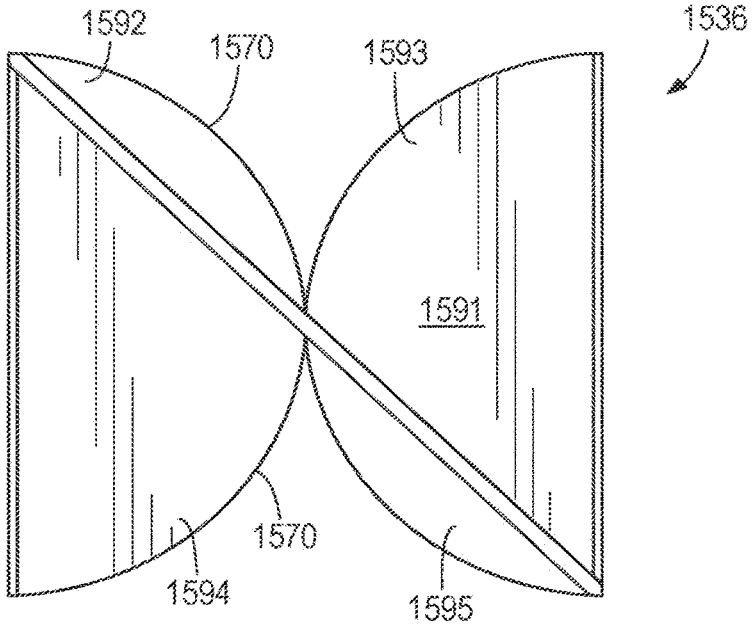
FIG. 34 is a side view of the mixer element of FIG. 33.

With reference to FIGS. 33-34, a mixer element 1536 is illustrated with a dividing wall 1591 including cusp-shaped openings 1570. The dividing wall 1591 includes four curved flange portions 1592-1595.

Figure 35:
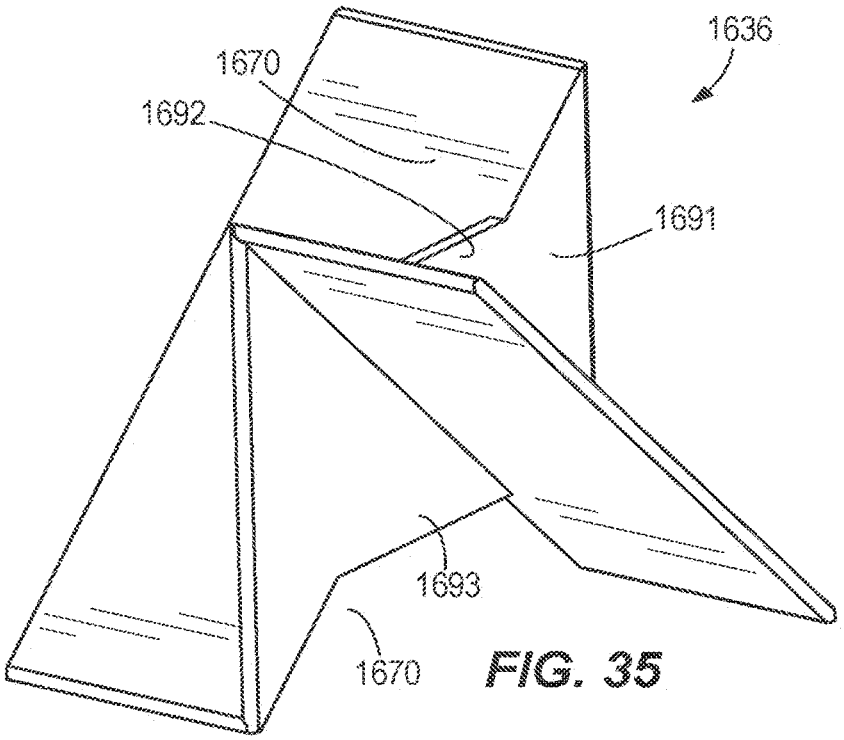
FIG. 35 is a perspective view of a mixer element according to another aspect of the invention.
Figure 36:
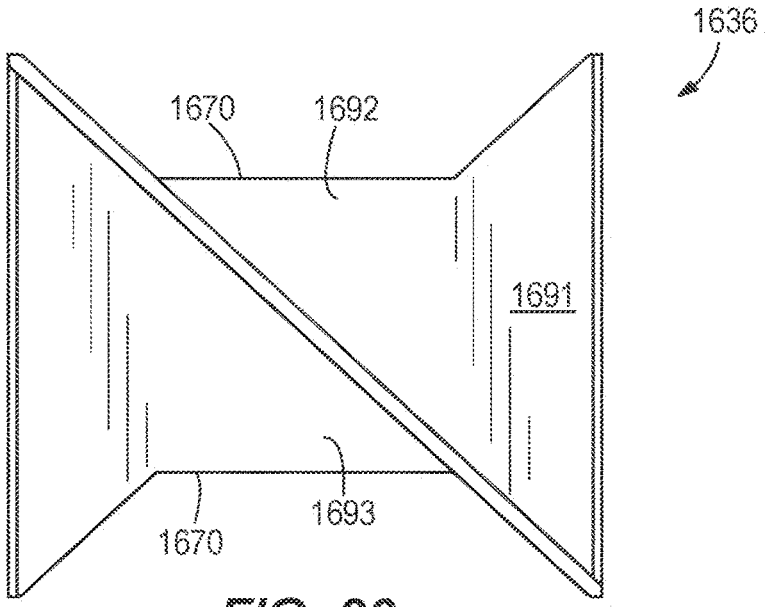
FIG. 36 is a side view of the mixer element of FIG. 35.

With reference to FIGS. 35-36, a mixer element 1636 is illustrated with a dividing wall 1691 including opening 1670 partially defined by linear, horizontal flanges 1692, 1693.

Figure 37:
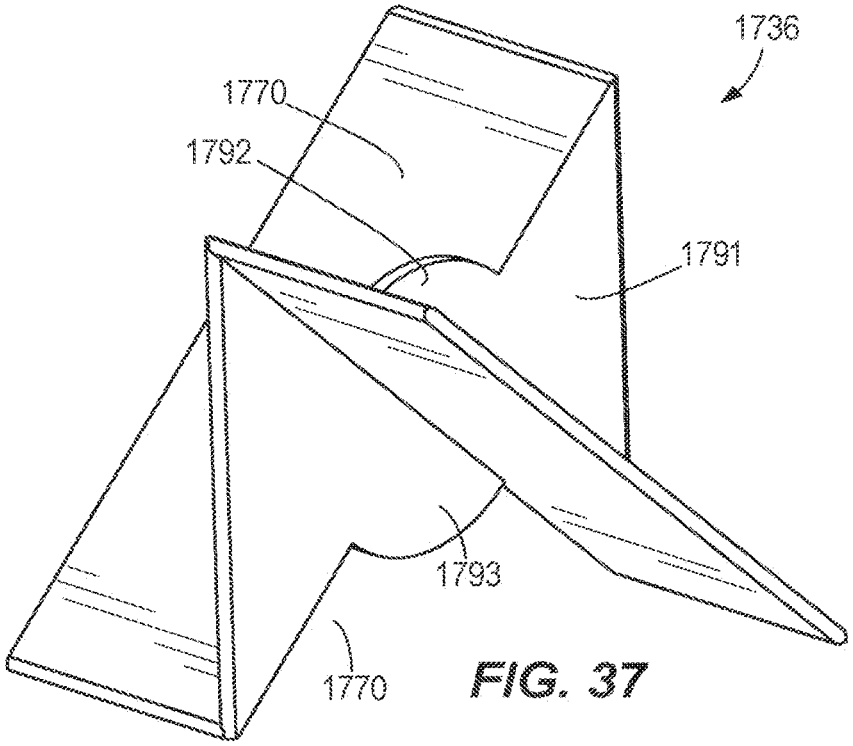
FIG. 37 is a perspective view of a mixer element according to another aspect of the invention.
Figure 38:
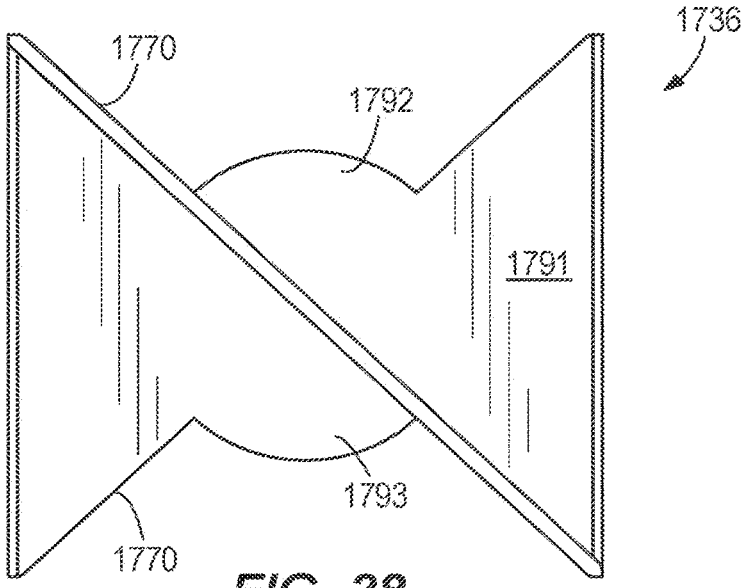
FIG. 38 is a side view of the mixer element of FIG. 37.

With reference to FIGS. 37-38, a mixer element 1736 is illustrated with a dividing wall 1791 including openings 1770 partially defined by curved flanges 1792, 1793.

Figure 39:
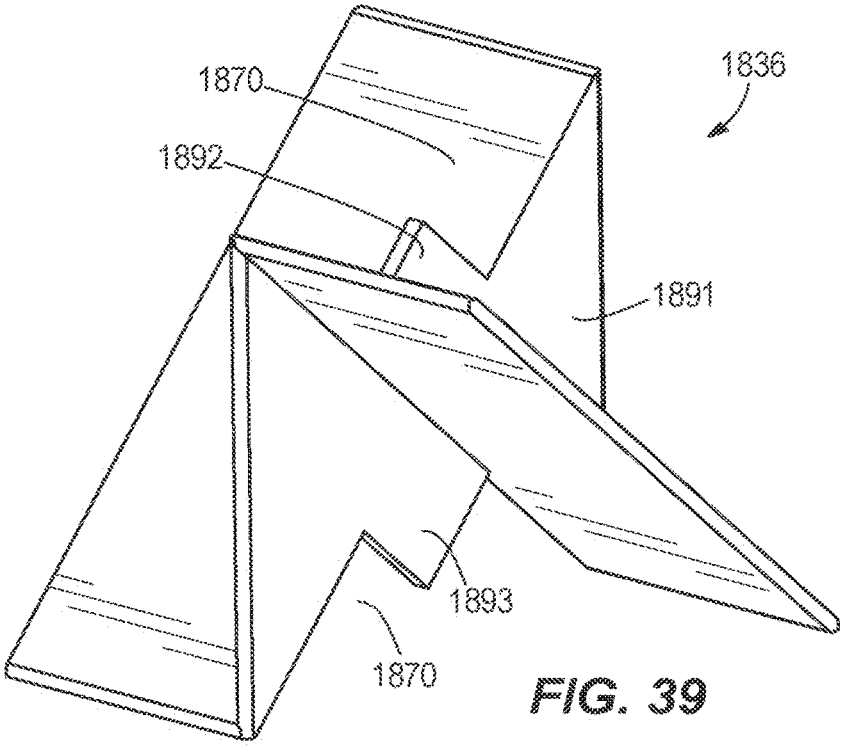
FIG. 39 is a perspective view of a mixer element according to another aspect of the invention.
Figure 40:
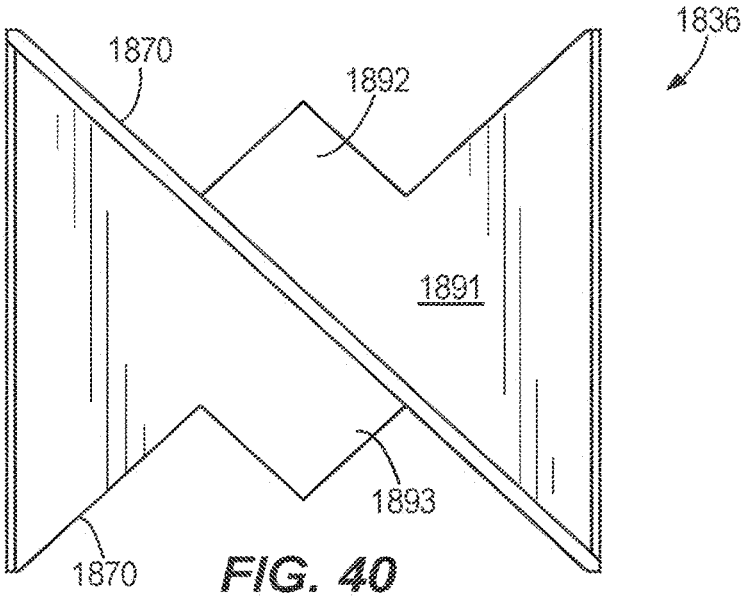
FIG. 40 is a side view of the mixer element of FIG. 39.

With reference to FIGS. 39-40, a mixer element 1836 is illustrated with a dividing wall 1891 including an opening 1870 partially defined by triangular-shaped flanges 1892, 1893.

Figure 41:
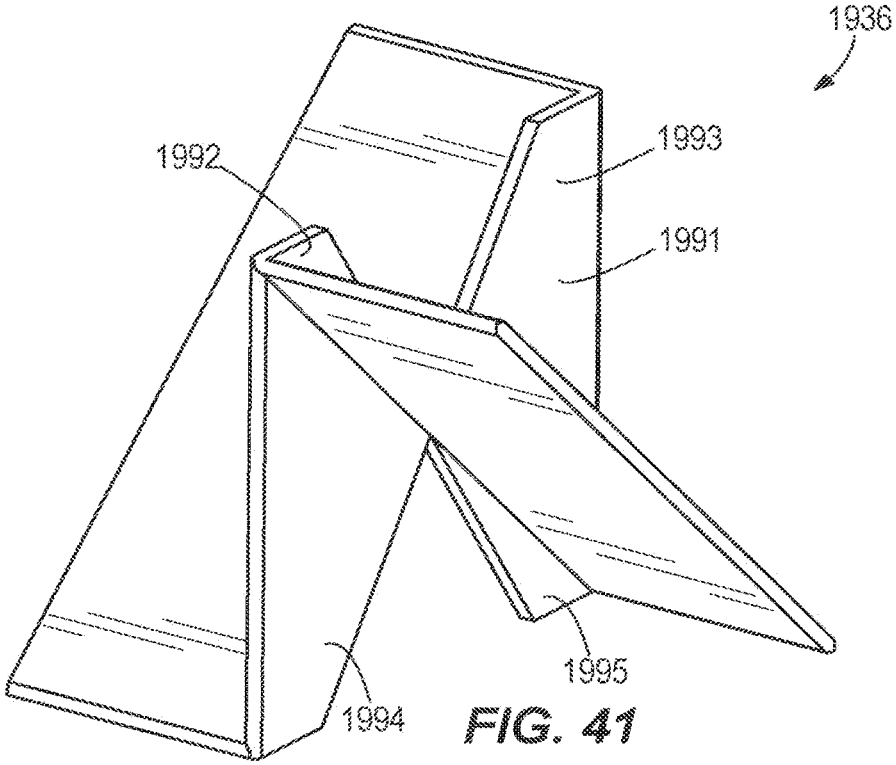
FIG. 41 is a perspective view of a mixer element according to another aspect of the invention.
Figure 42:
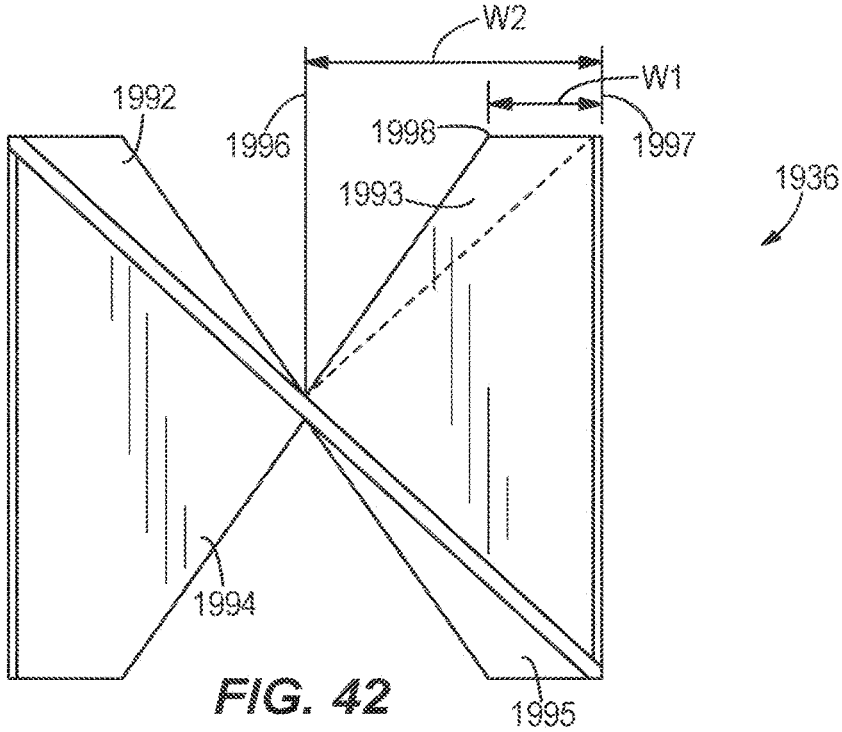
FIG. 42 is a side view of the mixer element of FIG. 41.

With reference to FIGS. 41-42, a mixer element 1936 is illustrated with a dividing wall 1991 including inner flanges 1992-1995. The flanges 1992-1995 include a dimension W2 between a center 1996 of the mixer element 1936 and a downstream edge 1997. A dimension W1 is defined between the downstream edge 1997 and a point 1998 where the flange extends horizontally before angling towards the center of the mixer element 1936. In the illustrated embodiments of FIGS. 41-42, the W1/W2 ratio is approximately 0.4.

Figure 43:
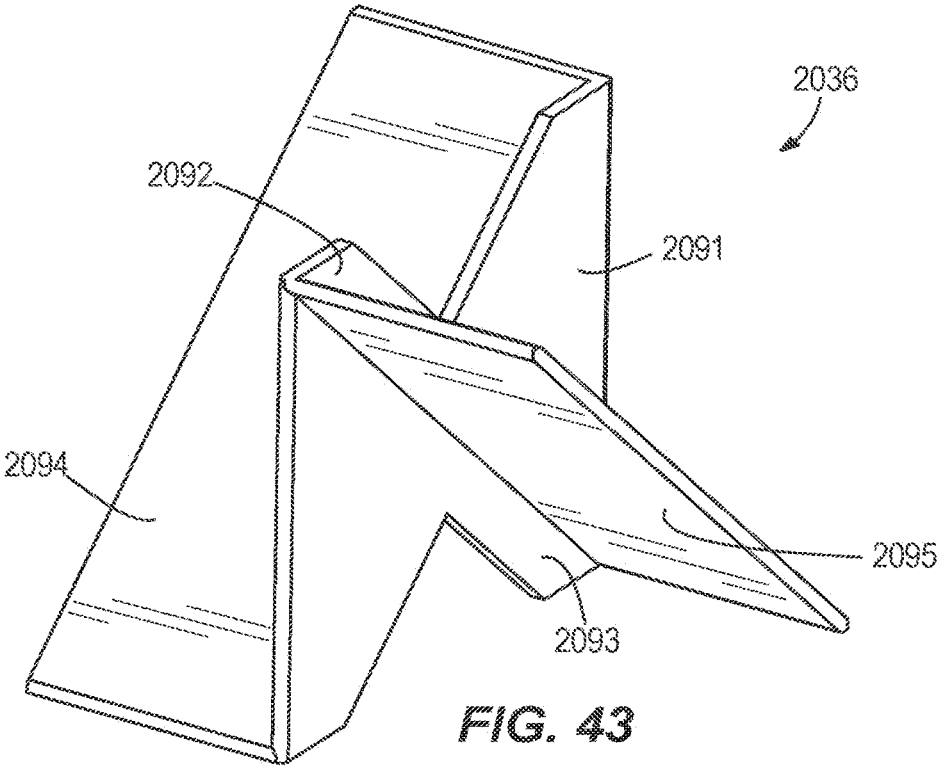
FIG. 43 is a perspective view of a mixer element according to another aspect of the invention.
Figure 44:
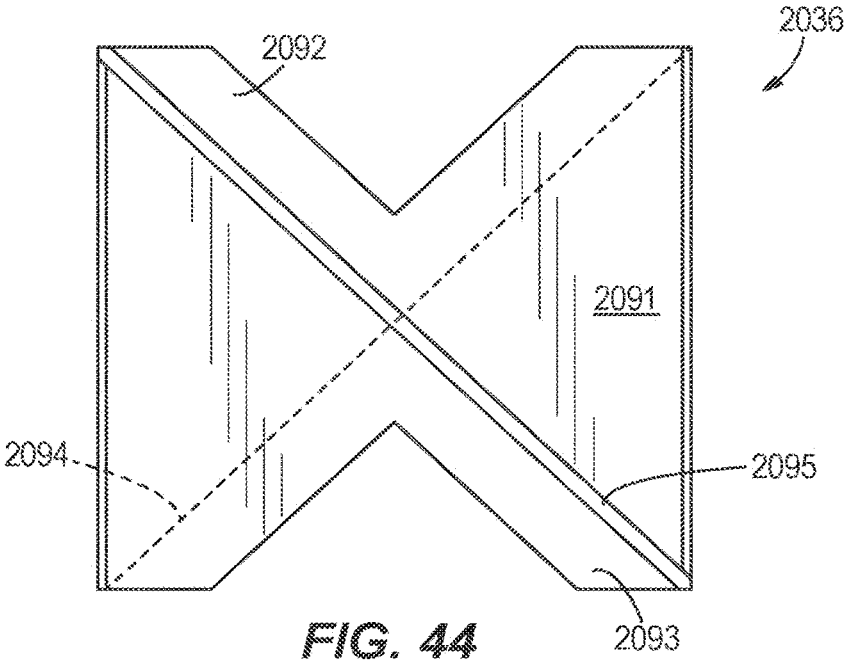
FIG. 44 is a side view of the mixer element of FIG. 43.

With reference to FIGS. 43-44, a mixer element 2036 is illustrated with a dividing wall 2091 including a parallel offset flanges 2092, 2093. In particular, the flanges 2092, 2093 are offset from and extend parallel to the guide walls 2094, 2095.

Figure 45:
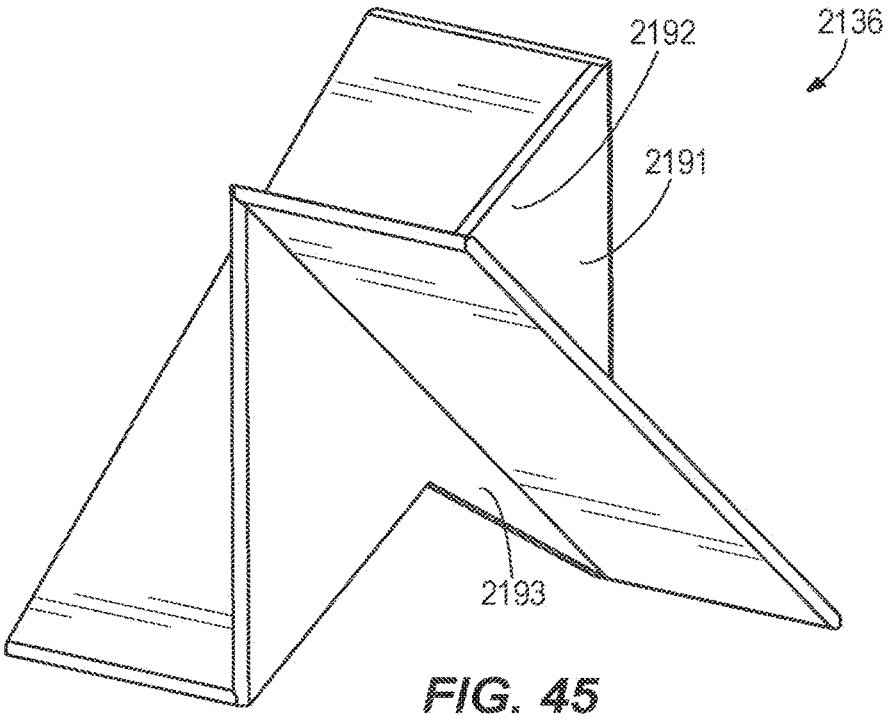
FIG. 45 is a perspective view of a mixer element according to another aspect of the invention.
Figure 46:
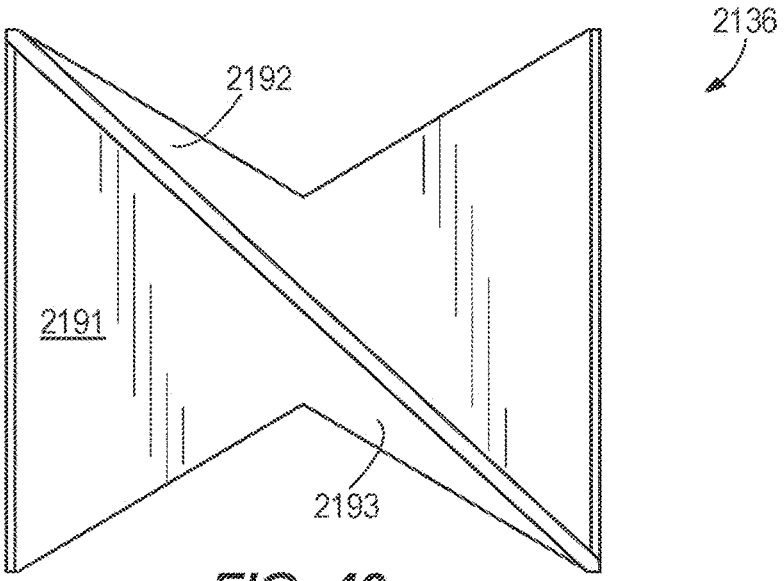
FIG. 46 is a side view of the mixer element of FIG. 45.

With reference to FIGS. 45-46, a mixer element 2136 is illustrated with a dividing wall 2191 including alternative outer flanges 2192, 2193.

Figure 47:
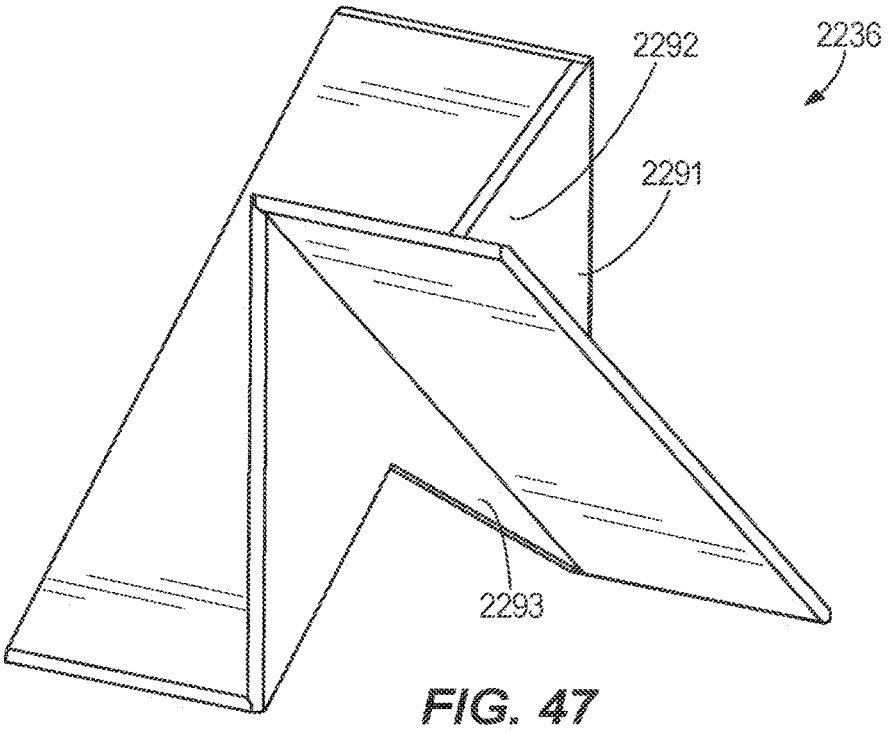
FIG. 47 is a perspective view of a mixer element according to another aspect of the invention.
Figure 48:
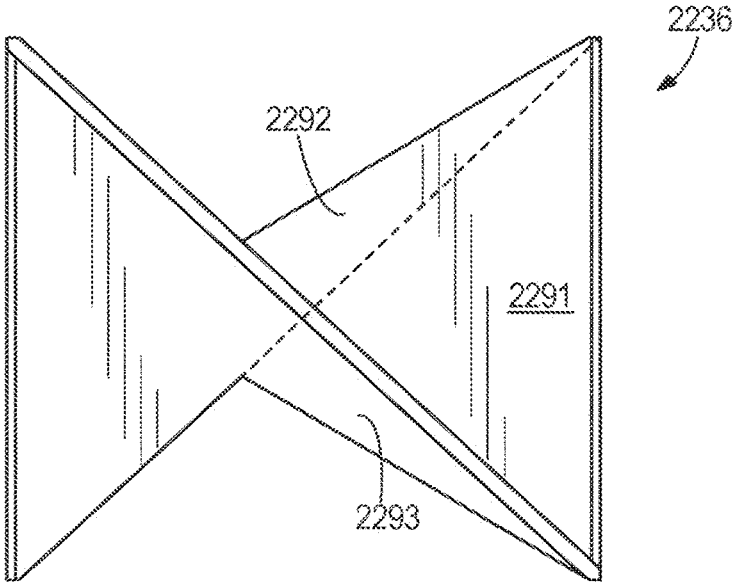
FIG. 48 is a side view of the mixer element of FIG. 47.

With reference to FIG. 47-48, a mixer element 2236 is illustrated with a dividing wall 2291 including asymmetric flanges 2292, 2293.

Although the dividing wall alternatives of FIGS. 29-48, have only been illustrated with a single wave segment and linear guide wall shapes, any combinations of wave segment number, guide wall shape, and dividing wall shape are considered herein.

With reference to FIGS. 49-54, various alternative mixer assemblies are illustrated. In particular, various combinations of mixer elements in mixer assemblies are illustrated in FIGS. 49-54.

Figure 49:
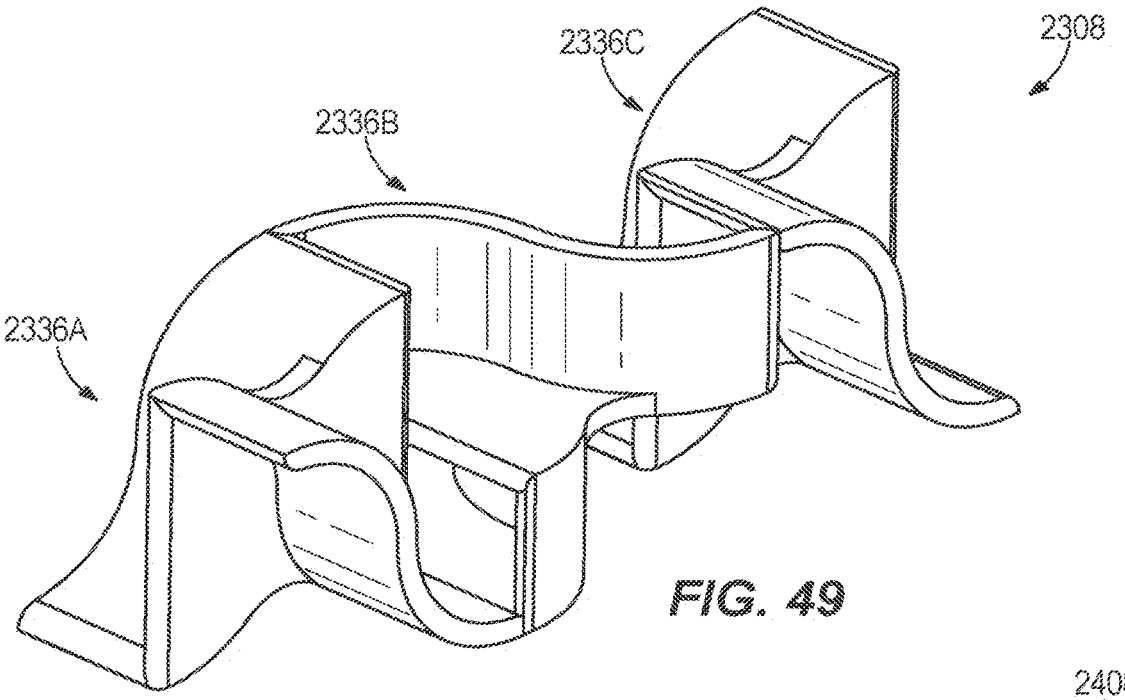
FIG. 49 is a perspective view of a mixer assembly according to another aspect of the invention.

With reference to FIG. 49, a mixer assembly 2308 including three mixer elements 2336A-2336C is illustrated. The three mixer elements 2336A-2336C are each a single wave wall segment mixer element.

Figure 50:
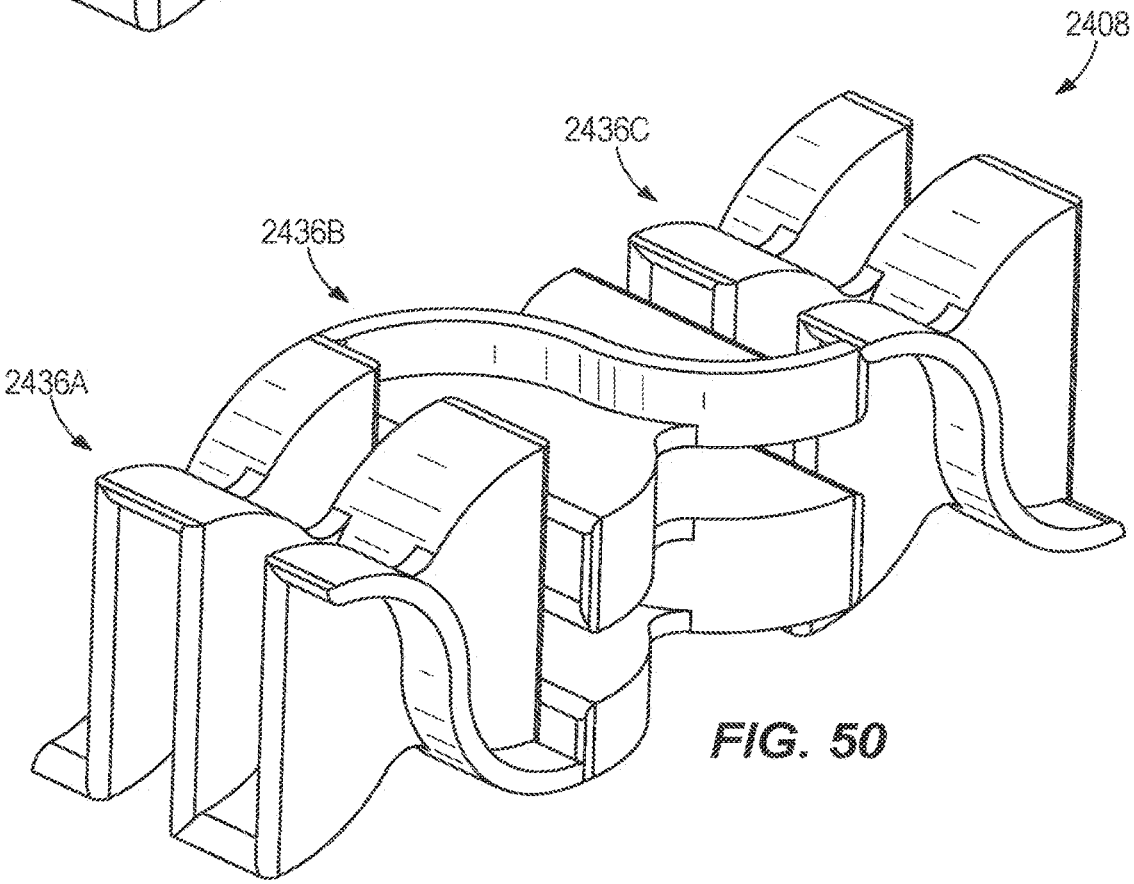
FIG. 50 is a perspective view of a mixer assembly according to another aspect of the invention.

With reference to FIG. 50, a mixer assembly 2408 including three mixer elements 2436A-2436C is illustrated. The three mixer elements 2436A-2436C are each a three wave wall segment mixer element.

Figure 51:
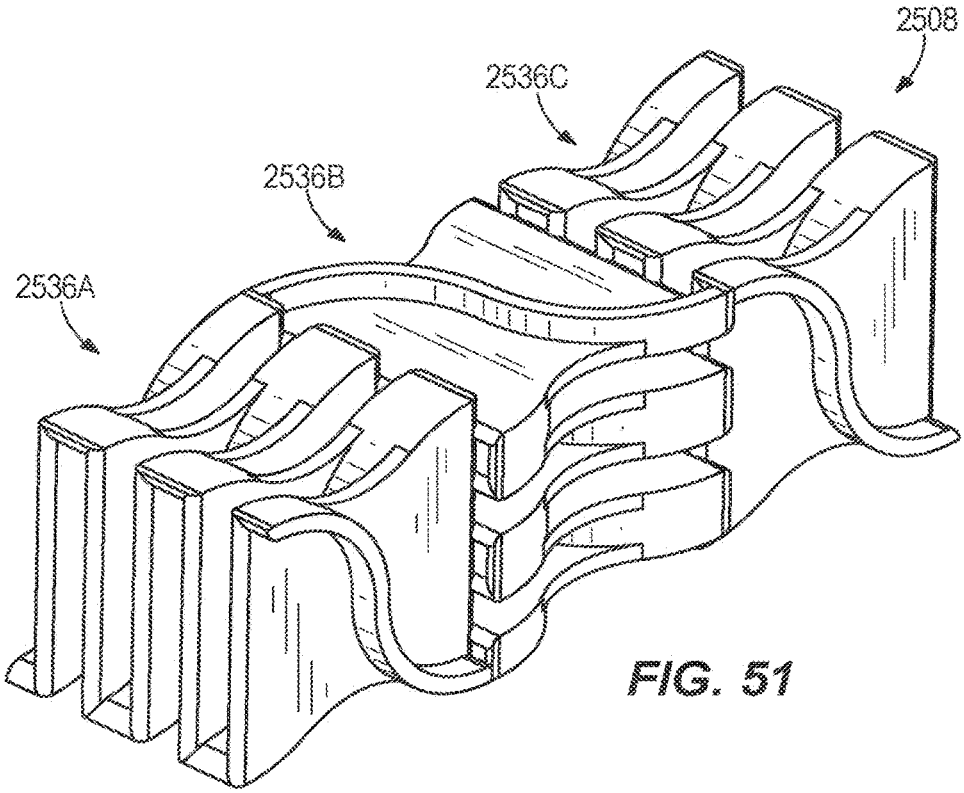
FIG. 51 is a perspective view of a mixer assembly according to another aspect of the invention.

With reference to FIG. 51, a mixer assembly 2508 including three mixer elements 2536A-2536C is illustrated. The three mixer elements 2536A-2536C are each a five wave wall segment mixer element.

Figure 52:
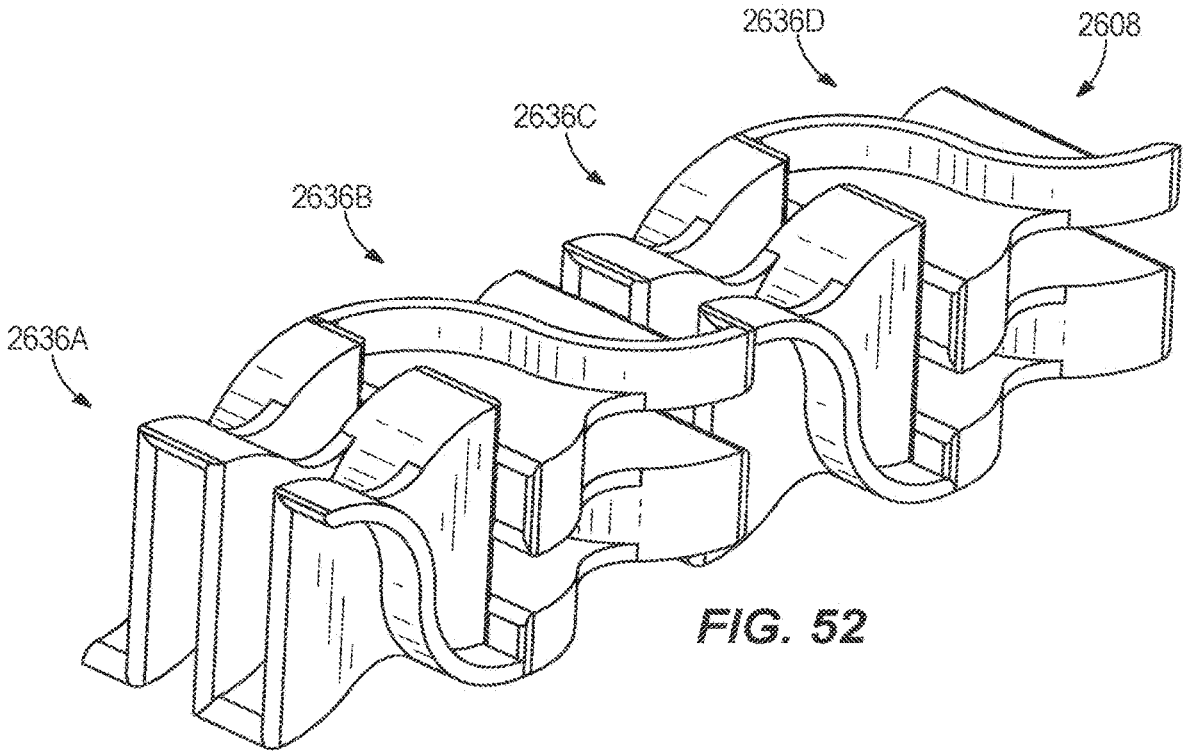
FIG. 52 is a perspective view of a mixer assembly according to another aspect of the invention.

With reference to FIG. 52, a mixer assembly 2608 including four mixer elements 2636A-2636D is illustrated. The four mixer elements 2636A-2636D are each a three wave wall segment mixer element.

Figure 53:
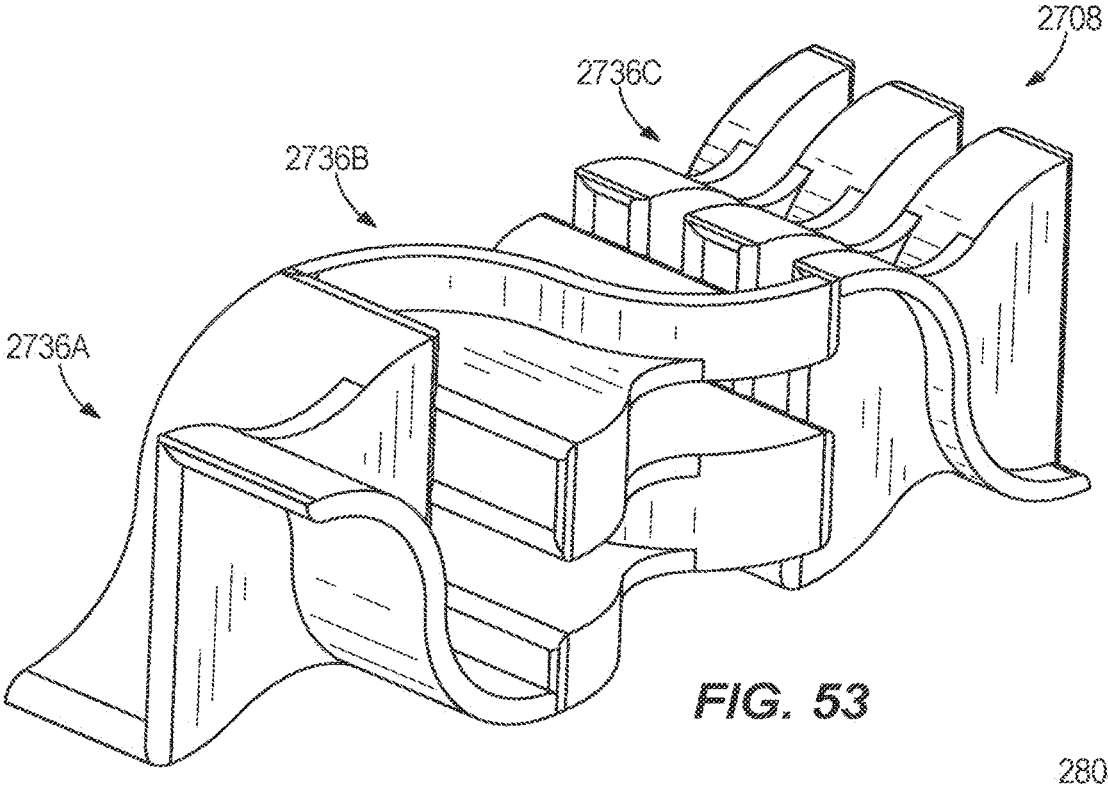
FIG. 53 is a perspective view of a mixer assembly according to another aspect of the invention.

With reference to FIG. 53, a mixer assembly 2708 including three mixer elements 2736A-2736C is illustrated. The first mixer element 2736A is a single wave wall segment mixer element. The second mixer element 2736B is a three wave wall segment mixer element. The third mixer element 2736C is a five wave wall segment mixer element. As such, the number of wave wall segments increases in the downstream mixer elements.

Figure 54:
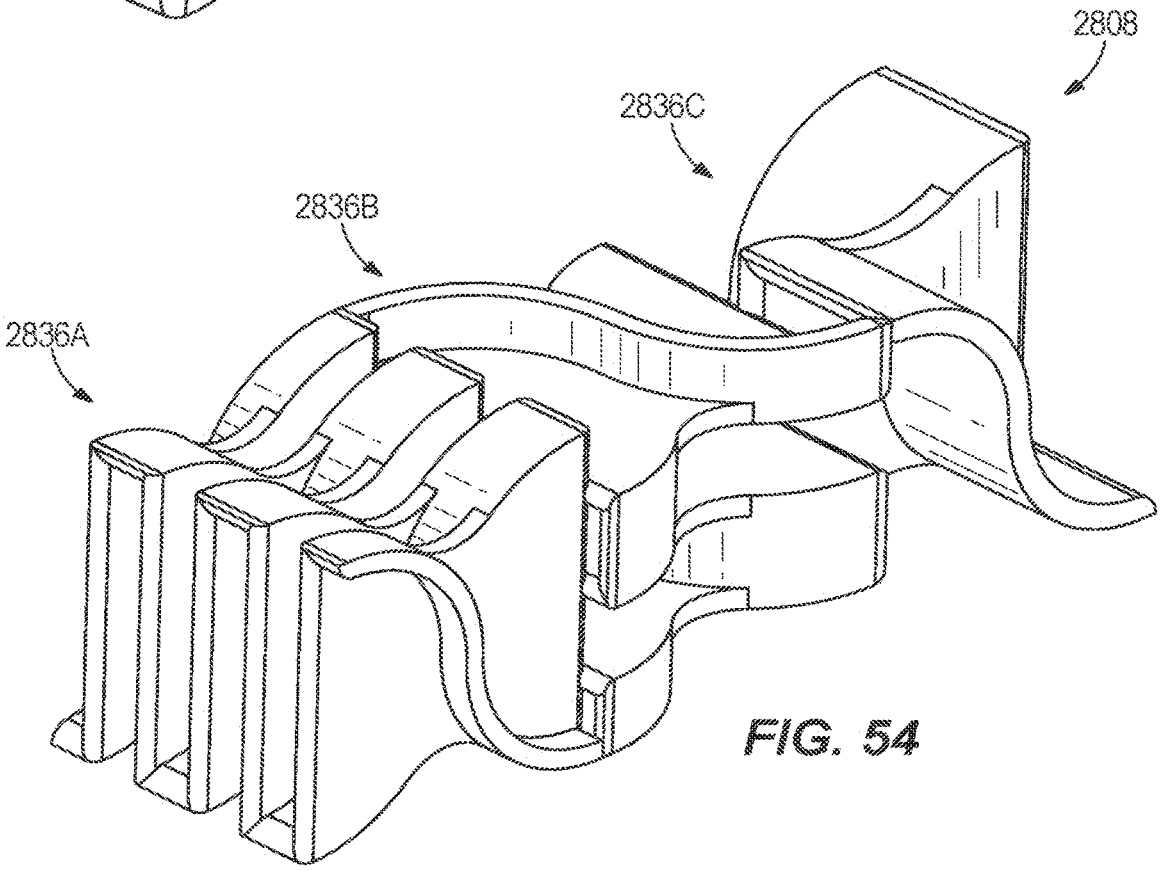
FIG. 54 is a perspective view of a mixer assembly according to another aspect of the invention.

With reference to FIG. 54, a mixer assembly 2808 including three mixer elements 2836A-2836C is illustrated. The first mixer element 2836A is a five wave wall segment mixer element. The second mixer element 2836B is a three wave wall segment mixer element. The third mixer element 2836C is a single wave wall segment mixer element. As such, the number of wave wall segments decreases in the downstream mixer elements.

Figure 55:
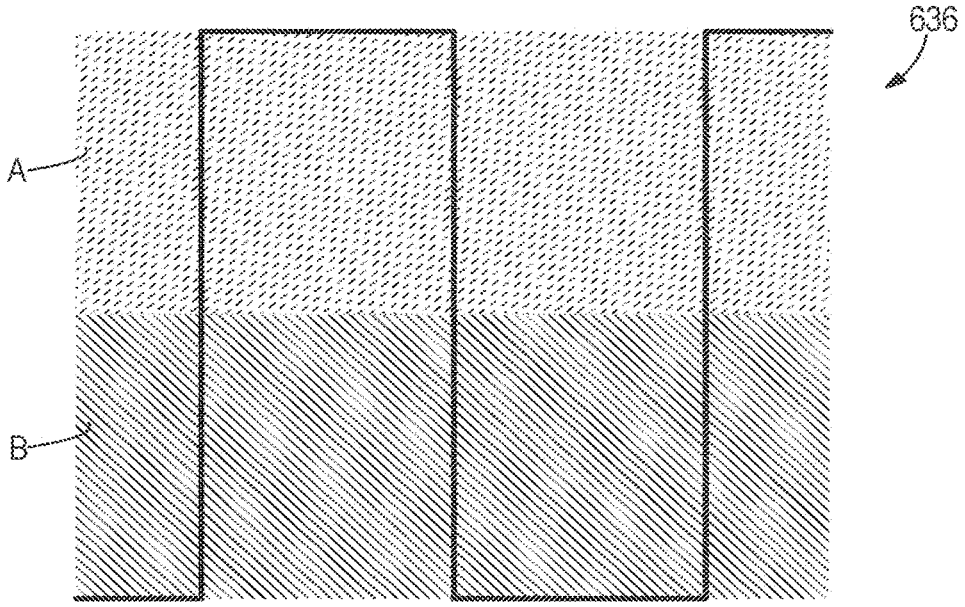
FIG. 55 is a cross-sectional view of a mixer element illustrating two different materials entering the mixer element.
Figure 56:
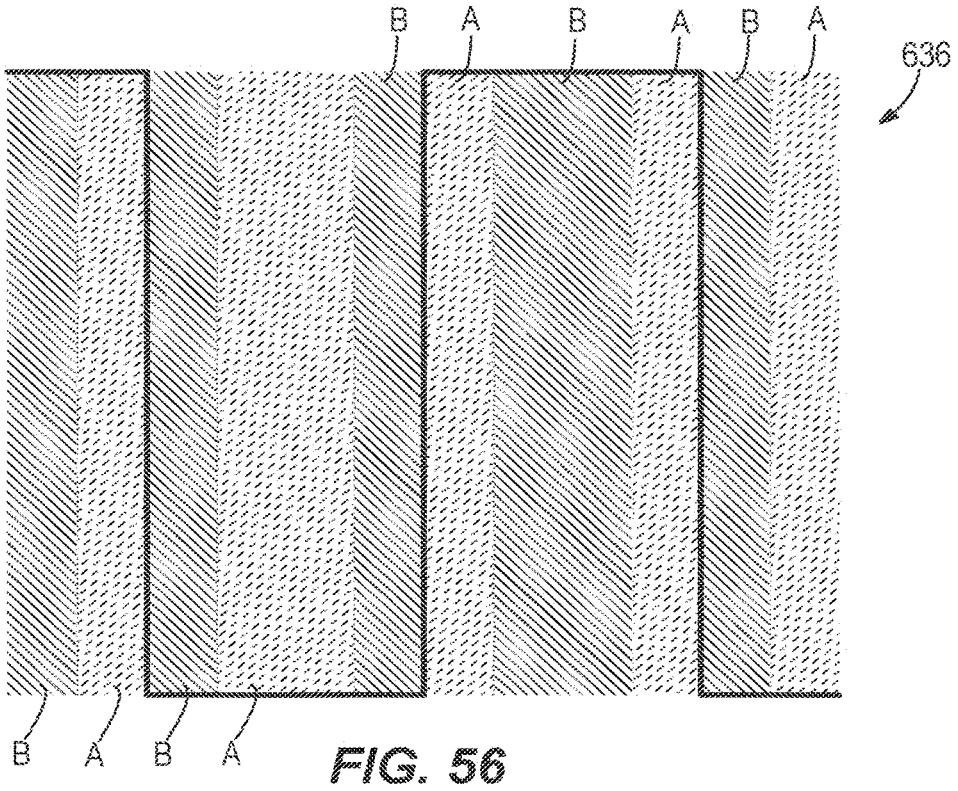
FIG. 56 is a cross-sectional view of the mixer element of FIG. 55, taken downstream to illustrate the two different materials exiting the mixer element.
Figure 57:
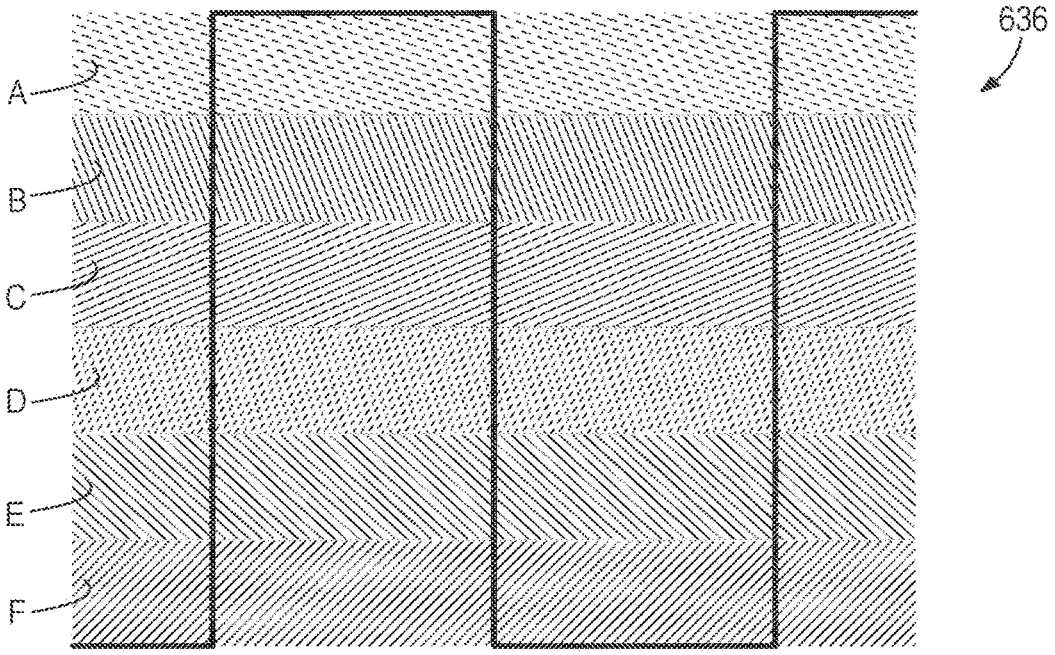
FIG. 57 is a cross-sectional view of a mixer element illustrating six different materials entering the mixer element.
Figure 58:
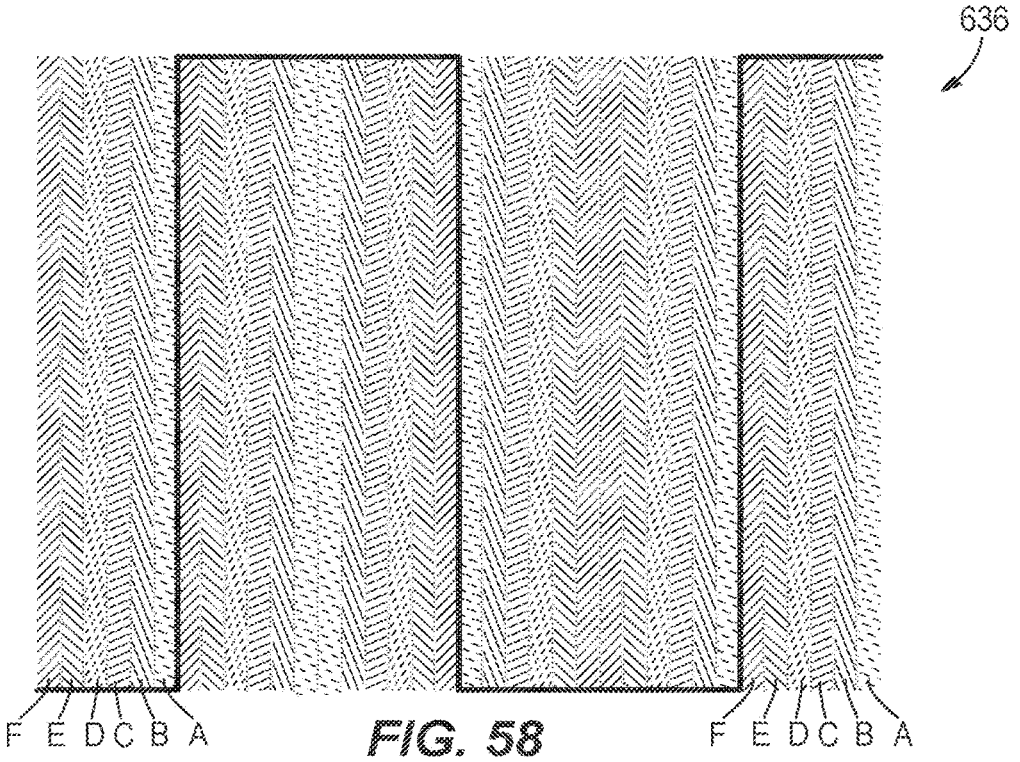
FIG. 58 is a cross-sectional view of the mixer element of FIG. 57, taken downstream to illustrate the six different materials exiting the mixer element.

With reference to FIGS. 55 and 56, two materials A and B moving through a three wave mixer element (similar to the mixer element 636, FIG. 17) is illustrated. Specifically, FIG. 55 illustrates the two separated materials A and B as they enter the three wave mixer element 636. Correspondingly, FIG. 56 illustrates the two materials A and B mixed as they exit the three wave mixer element 636. The mixer elements are not limited to mixing two materials and are operable to mix more than two materials. For example, FIGS. 57 and 58 illustrate six materials A-F moving through the three wave mixer element 636. As before, FIG. 57 illustrates the six separated materials A-F as they enter the three wave mixer element 636, and FIG. 58 illustrates the six materials A-F mixed as they exit the three wave mixer element 636.

Figure 59A:
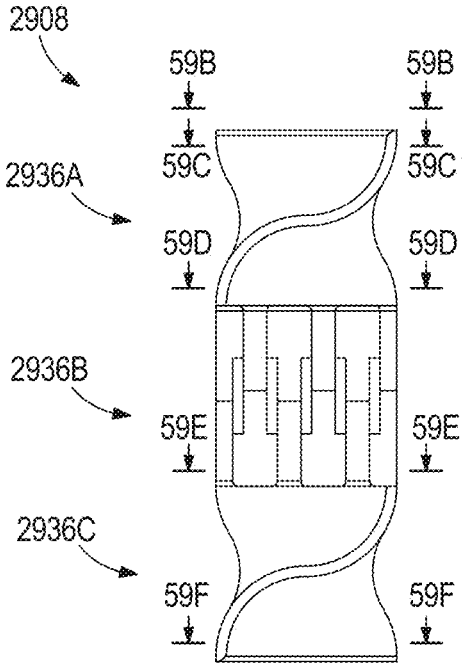
FIG. 59A is a top view of a mixer assembly according to an aspect of the invention.
Figure 59B:
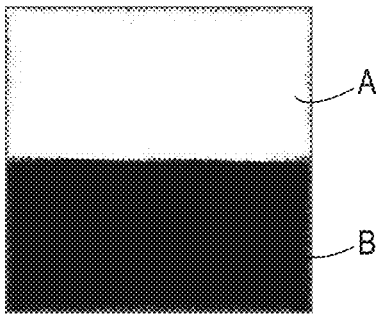
FIG. 59B is a cross-sectional view of the mixer assembly of FIG. 59A, taken along lines 59B-59B shown in FIG. 59A, illustrating two materials traveling through the mixer assembly.
Figure 59C:
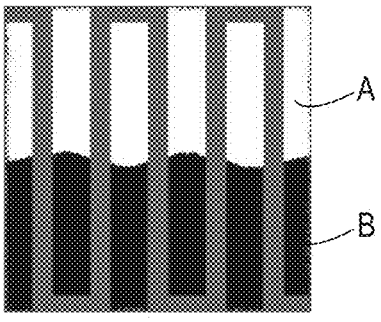
FIG. 59C is a cross-sectional view of the mixer assembly of FIG. 59A, taken along lines 59C-59C shown in FIG. 59A, illustrating two materials traveling through the mixer assembly.
Figure 59D:
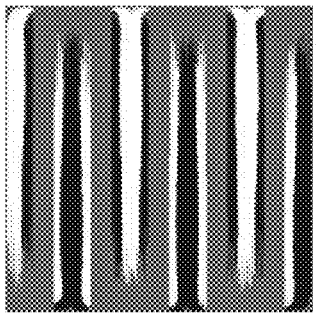
FIG. 59D is a cross-sectional view of the mixer assembly of FIG. 59A, taken along lines 59D-59D shown in FIG. 59A, illustrating two materials traveling through the mixer assembly.
Figure 59E:
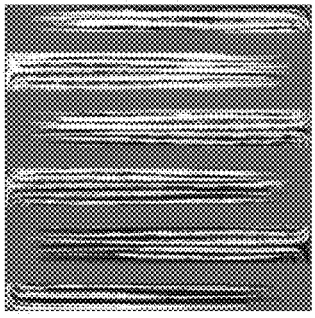
FIG. 59E is a cross-sectional view of the mixer assembly of FIG. 59A, taken along lines 59E-59E shown in FIG. 59A, illustrating two materials traveling through the mixer assembly.
Figure 59F:
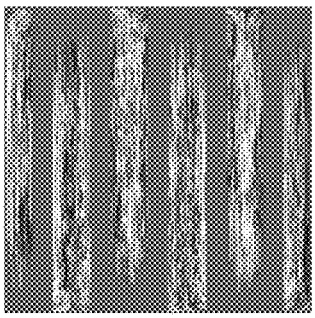
FIG. 59F is a cross-sectional view of the mixer assembly of FIG. 59A, taken along lines 59F-59F shown in FIG. 59A, illustrating two materials traveling through the mixer assembly.

With reference to FIGS. 59A-59F, a numerical simulation is utilized to better understand how two materials A and B flow through a mixer assembly 2908. In particular, FIG. 59A illustrates the mixer assembly 2908 with three mixer elements 2936A-2936C that are each five wave wall segment mixer elements. The section views of FIGS. 59B-59F illustrate how the two materials A and B flow between various stages of the mixer assembly 2908. Material A is illustrated as white, Material B is illustrated as black, and the structure of the mixer assembly 2908 is illustrated as grey. Section view FIG. 59F clearly illustrates a homogenous mixture of Material A and Material B as they exit the mixer assembly 2908.

Figure 60:
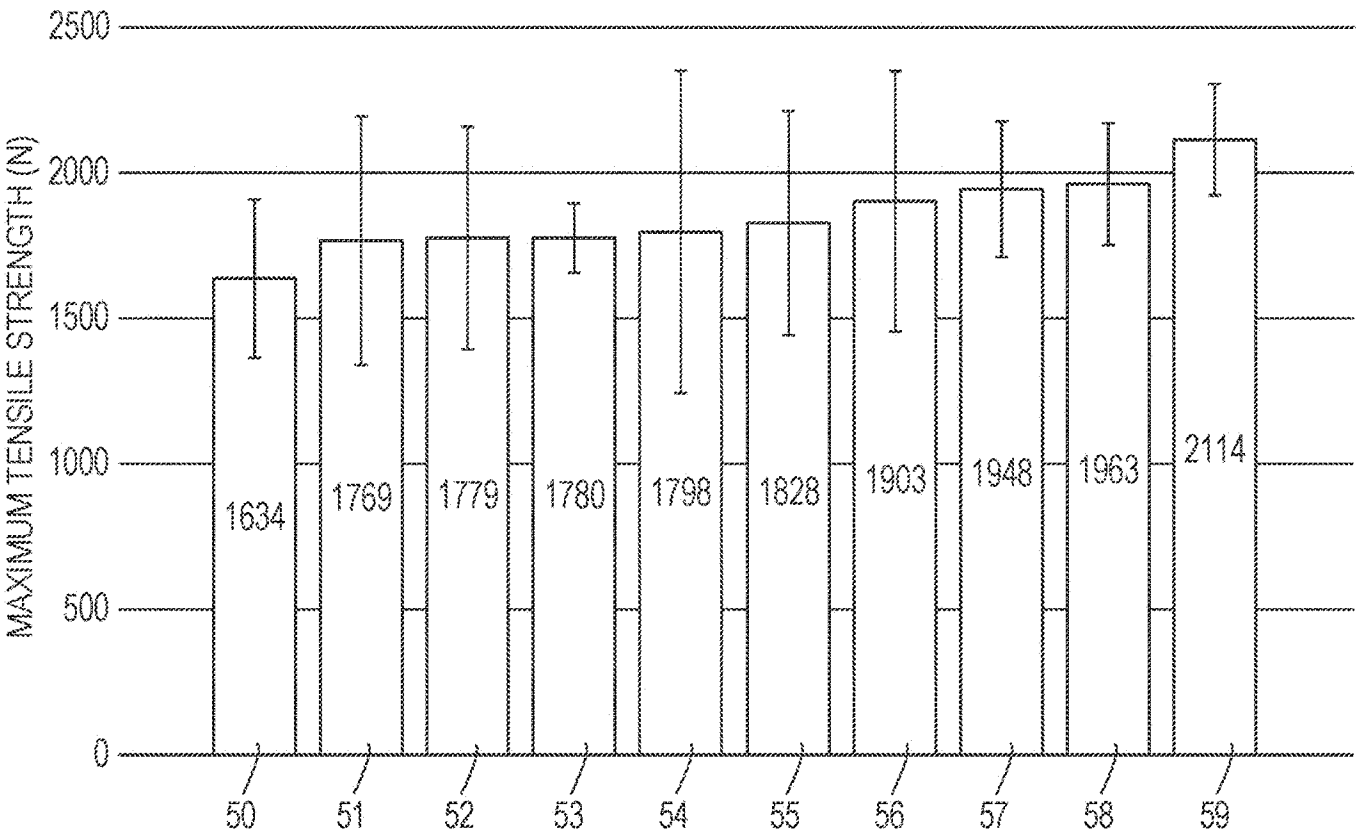
FIG. 60 is a graph of empirical results illustrating maximum tensile strength achieved for adhesive mixtures that have passed through various static mixers.

With reference to FIG. 60, empirical test results are illustrated according to the ASTM-D1002 testing procedure (i.e., "Standard Test Method for Apparent Shear Strength of Single-Lap-Joint Adhesively Bonded Metal Specimens by Tension Loading (Metal-to-Metal)"). In particular, the maximum tensile strength of two components adhered together with a two part liquid resin is shown, with the difference being the resin was mixed with different static mixers. Specifically, the test used 0.063" thick high-strength 2024 Aluminum coupon samples with a length of overlap of 0.5". Two conventional static mixers 50 and 51 were tested and compared against static mixers 52-59 according to the invention described herein. Specifically static mixer 50 is Model No.: MCH 08-24T and static mixer 51 is Model No.: MCQ 08-24T (both of which are The conventional static mixer 50 has a length of 8.8 inches and a volume of 8.5 ml, and the conventional static mixer 51 has a length of 5.8 inches and a volume of 7.5 Sulzer Mixpac static mixers). ml. Static mixer 52 includes six mixer elements and each mixer element is a three wave wall segment design, and has a length of 2.0 inches and volume of 2.8 ml. Static mixer 53 includes two, three-wave wall segment mixer elements followed by two, five-wave wall segment mixer elements, and has a length of 1.3 inches and a volume of 1.9 ml. Static mixer 54 includes three, five-wave wall segment mixer elements with a smaller flange size, and has a length of 1.0 inches and a volume of 1.4 ml. Static mixer 55 includes five, three-wave wall segment mixer elements, and has a length of 1.7 inches and a volume of 2.4 ml. Static mixer 56 includes two, three-wave wall segment mixer elements followed by three, five-wave wall segment mixer elements, and has a length of 1.7 inches and a volume of 2.4 ml. Static mixer 57 includes three, three-wave wall segment mixer elements followed by one, five-wave wall segment mixer elements, and has a length of 1.3 inches and a volume of 1.9 ml. Static mixer 58 includes four, three-wave wall segment mixer element, and has a length of 1.3 inches and a volume of 1.9 ml. Static mixer 59 includes one, three-wave wall segment mixer element followed by three, five-wave wall segment mixer elements, and has a length of 1.3 inches and a volume of 1.9 ml.

As evidenced by the experimental results of FIG. 60, the static mixers 52-59 perform better than the conventional mixers 50-51 with a shorter length mixer, which results in less wasted retained volume. Specifically, the maximum tensile strength achieved by adhering two components together with resin that has been mixed with the inventive static mixers 52-59 is greater than the maximum tensile strength achieved by adhering two components together with resin that has been mixed with the conventional static mixers 50-51 (all while using a shorter length mixer with less retained volume). In addition, the static mixers 52-29 achieved these results with pressure losses similar to the conventional mixers 50-51.

The static mixer 100 and alternative static mixers described herein can be utilized for various mass transfer, heat transfer, or homogenization applications. For example, the static mixer 100 can be utilized in petrochemical industries (e.g., blending heavy oil products); chemical industries (e.g., mixing process fluids: caustic soda and sulfuric acid); man-made fiber industries (e.g., spinnerets); plastics industries (e.g., plastic extrusion); two liquid type resin adhesive industries; pulp and paper industries (e.g., pulp bleaching); gas industries (e.g., calorie control of city gas); food industries (e.g., chocolate or yogurt production); water treatment (e.g., waste water treatment); hot water supply systems; reactors; heat exchangers; etc.

Various features and advantages of the invention are set forth in the following claims.

What is claimed is:

1. A mixer comprising:

a first inlet channel;

a first outlet channel aligned with the first inlet channel;

a second inlet channel;

a second outlet channel aligned with the second inlet channel;

a third inlet channel;

a third outlet channel aligned with the third inlet channel;

a first dividing wall having the first inlet and outlet channels on one side and the second inlet and outlet channels on the other side;

a first opening formed in the first dividing wall between the first inlet channel and the second outlet channel;

a second opening formed in the first dividing wall between the second inlet channel and the first outlet channel;

a second dividing wall having the second inlet and outlet channels on one side and the third inlet and outlet channels on the other side;

a third opening formed in the second dividing wall between the third inlet channel and the second outlet channel;

a fourth opening formed in the second dividing wall between the second inlet channel and the third outlet channel; and a first guide wall that separates the first inlet channel and the first outlet channel such that the first inlet channel is not in fluid communication with the first outlet channel;

wherein the first opening is aligned with the third opening along a first axis and the second opening is aligned with the fourth opening along a second axis.

2. The mixer of claim 1, wherein the first axis is parallel to the second axis.

3. The mixer of claim 1, wherein the first dividing wall includes a flange at least partially defining the first opening.

4. The mixer of claim 1, wherein the first guide wall is non-planar.

5. The mixer of claim 4, wherein the first guide wall is S-shaped.

6. The mixer of claim 1, wherein the first outlet channel is aligned with the first inlet channel along a third axis, the second outlet channel is aligned with the second inlet channel along a fourth axis, the third outlet channel is aligned with the third inlet channel along a fifth axis; wherein the third axis, the fourth axis, and the fifth axis are parallel.

7. The mixer of claim 1, wherein the first dividing wall and the second dividing wall are parallel.

8. The mixer of claim 1, wherein the first opening is triangular-shaped.

9. The mixer of claim 1, wherein a portion of the first opening is defined by a constant radius.

10. The mixer of claim 1, wherein an outer periphery of the first dividing wall at least partially defines the first opening and at least partially defines the second opening.

11. The mixer of claim 1, further including a housing and the first inlet channel is partially bounded by the housing.

12. The mixer of claim 1, further including a second guide wall that separates the second inlet channel and the second outlet channel such that the second inlet channel is not in fluid communication with the second outlet channel.

13. The mixer of claim 12, further including a third guide wall that separates the third inlet channel and the third outlet channel such that the third inlet channel is not in fluid communication with the third outlet channel.

14. The mixer of claim 13, wherein the first guide wall, the second guide wall, and the third guide wall are non-planar.

15. The mixer of claim 6, wherein the first axis is perpendicular to the third axis.

16. The mixer of claim 10, wherein a second outer periphery of the second dividing wall at least partially defines the third opening and at least partially defines the fourth opening.

17. The mixer of claim 5, wherein the first guide wall is sigmoid-shaped.

18. The mixer of claim 5, wherein the first opening is cusp-shaped.

19. The mixer of claim 3, wherein the flange is a first flange and the first dividing wall further includes a second flange at least partially defining the first opening.

* * * * *